US009512842B2

(12) United States Patent
Shimizu et al.

(10) Patent No.: US 9,512,842 B2
(45) Date of Patent: Dec. 6, 2016

(54) ROTARY COMPRESSOR

(75) Inventors: Takashi Shimizu, Sakai (JP); Kazutaka Hori, Sakai (JP); Hirofumi Higashi, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 197 days.

(21) Appl. No.: 13/378,579

(22) PCT Filed: Jun. 15, 2010

(86) PCT No.: PCT/JP2010/003972

§ 371 (c)(1),
(2), (4) Date: Dec. 15, 2011

(87) PCT Pub. No.: WO2010/146837

PCT Pub. Date: Dec. 23, 2010

(65) Prior Publication Data

US 2012/0087819 A1 Apr. 12, 2012

(30) Foreign Application Priority Data

Jun. 16, 2009 (JP) ..... 2009-143242

(51) Int. Cl.

| | |
|---|---|
| ***F04C 29/06*** | (2006.01) |
| ***F04C 18/32*** | (2006.01) |
| ***F04C 23/00*** | (2006.01) |
| ***F04C 29/00*** | (2006.01) |

(Continued)

(52) U.S. Cl.

CPC ..... *F04C 29/068* (2013.01); *F04C 18/322* (2013.01); *F04C 23/008* (2013.01);

(Continued)

(58) Field of Classification Search

CPC ..... F04C 18/322; F04C 2240/809; F04C 23/008; F04C 29/0007; F04C 29/02; F04C 29/023; F04C 29/061; F04C 29/068; F04C 29/122

USPC ..... 418/76, 79, 81, 11, 60, 63, 83, 88, 94, 418/98, 102, 270; 417/463

See application file for complete search history.

(56) References Cited

U.S. PATENT DOCUMENTS

| | | | | |
|---|---|---|---|---|
| 7,029,252 | B2 * | 4/2006 | Masuda et al. | 418/63 |
| 2003/0126884 | A1 | 7/2003 | Bush et al. | |
| 2005/0069423 | A1 | 3/2005 | Ebara et al. | |

FOREIGN PATENT DOCUMENTS

| | | | |
|---|---|---|---|
| JP | 58-62193 | U | 4/1983 |
| JP | 63-97895 | A | 4/1988 |

(Continued)

OTHER PUBLICATIONS

English Machine Translation of JP 406167287 A.*

(Continued)

*Primary Examiner* — Nicholas J Weiss
*Assistant Examiner* — Paul Thiede
(74) *Attorney, Agent, or Firm* — Global IP Counselors

(57) ABSTRACT

A high pressure dome type rotary compressor including a casing and a compression mechanism disposed in the casing to compress gas in a cylinder chamber. The compression mechanism has a discharge port and a discharge valve. The discharge valve is opened in a discharge process and is closed during a period from when the discharge process is finished to when a next compression process is started. The compressor is arranged such that high pressure gas discharged from the discharge port in the discharge process is discharged outside the casing through space in the casing. An oil feed path is arranged to feed lubricant oil contained in a bottom of the casing to an inside of the discharge port in a period from a point in time in the discharge process to when the compression process is started.

14 Claims, 11 Drawing Sheets

(51) Int. Cl.
*F04C 29/02* (2006.01)
*F04C 29/12* (2006.01)

(52) U.S. Cl.
CPC ..... *F04C29/0007* (2013.01); *F04C 29/061* (2013.01); *F04C 29/02* (2013.01); *F04C 29/023* (2013.01); *F04C 29/122* (2013.01); *F04C 2240/809* (2013.01)

(56) References Cited

FOREIGN PATENT DOCUMENTS

| | | | |
|---|---|---|---|
| JP | 1-124092 | U | 8/1989 |
| JP | 2-50087 | U | 4/1990 |
| JP | 6-167287 | A | 6/1994 |
| JP | 6-346878 | A | 12/1994 |
| JP | 8-219051 | A | 8/1996 |
| JP | 8-219069 | A | 8/1996 |
| JP | 8-219070 | A | 8/1996 |
| JP | 2005-113766 | A | 4/2005 |
| JP | 2005-139973 | A | 6/2005 |

OTHER PUBLICATIONS

International Search Report of corresponding PCT Application No. PCT/JP2010/003972.

European Search Report of corresponding EP Application No. 10 78 9218.4 dated Mar. 30, 2015.

* cited by examiner (A)

(B)

(A)

(B)

(A)

(B)

(A)

(B)

(C)

(A)

(B)

(A)

(B)

(A)

(B)

ROTARY COMPRESSOR

CROSS-REFERENCE TO RELATED APPLICATIONS

This U.S. National stage application claims priority under 35 U.S.C. §119(a) to Japanese Patent Application No. 2009-143242, filed in Japan on Jun. 16, 2009, the entire contents of which are hereby incorporated herein by reference.

TECHNICAL FIELD

The present invention relates to rotary compressors, particularly to a technology of reducing vibration and noise caused by high pressure gas which remains in a discharge port of a compression mechanism for compressing gas in a cylinder chamber when a discharge process is finished, and returns to the cylinder chamber to re-expand therein in a next compression process.

BACKGROUND ART

In conventional rotary compressors, for example, a cylinder chamber is divided into a low pressure chamber and a high pressure chamber by a blade. The low and high pressure chambers are switched to become the high and low pressure chambers, respectively, in accordance with the operation of a compression mechanism. Thus, a suction process in the low pressure chamber, and a compression process and a discharge process in the high pressure chamber are simultaneously performed, thereby compressing low pressure gas, and discharging high pressure gas. In the rotary compressors of this type, the high pressure gas remaining in a discharge port when the discharge process is finished returns to the low pressure cylinder chamber, and re-expands therein when a next compression process is started. This causes significant pressure pulsation near the discharge port. A rotary compressor including a mechanism for reducing vibration and noise caused by the pressure pulsation has been proposed (see, e.g., Japanese Patent Publication No. H08-219051).

The rotary compressor of Japanese Patent Publication No. H08-219051 includes a high pressure fluid injection mechanism for injecting high pressure fluid in a cylinder chamber through a high pressure fluid passage opened in the cylinder chamber after a suction port of a compression mechanism is completely closed by a piston.

In the compressor of Japanese Patent Publication No. H08-219051, the high pressure fluid injection mechanism brings the high pressure fluid (high pressure oil) into contact with gas which re-expanded and caused high frequency pulsation in the hermetic cylinder chamber to cause interference between the high frequency pulsation and high pressure, thereby reducing the high frequency pulsation. This can reduce vibration and noise caused by the high frequency pulsation.

SUMMARY

Technical Problem

In the compressor of Japanese Patent Publication No. H08-219051, the high pressure fluid injection mechanism is always open in the hermetic cylinder chamber. Thus, an amount of the oil fed to the cylinder chamber cannot easily be reduced, and an excessive amount of the high pressure oil may be fed to the low pressure cylinder chamber immediately after the suction port is completely closed. This is because this mechanism tends to be affected by a differential pressure.

In view of the foregoing, the present invention has been achieved. The present invention is concerned with reducing vibration and noise caused by the high pressure gas which remains in the discharge port of the compression mechanism when the discharge process is finished, and re-expands in the low pressure cylinder chamber when the next compression process is started, and preventing excessive feeding of the oil to the cylinder chamber.

Solution to the Problem

A first aspect of the invention is directed to a high pressure dome type rotary compressor including: a casing (10); a compression mechanism (20) which is provided in the casing (10) to compress gas in a cylinder chamber (25); and is provided with a discharge port (21*b*) which is formed in the compression mechanism (20), and is provided with a discharge valve (28*a*) which is opened in a discharge process, and is closed in a period from when the discharge process is finished to when a next compression process is started, the compressor being configured in such a manner that high pressure gas discharged from the discharge port (21*b*) in the discharge process is discharged outside the casing (10) through space in the casing (10).

As a feature of the rotary compressor, an oil feed path (40) is provided to feed lubricant oil contained in a bottom of the casing (10) to the inside of the discharge port (21*b*) in a period from a point in time in the discharge process to when the compression process is started.

According to the first aspect of the invention, low pressure gas is compressed to become high pressure gas by the operation of the compression mechanism (20). The high pressure gas which is discharged from the discharge port (21*b*) of the compression mechanism (20) to the inside of the casing (10) of the compressor in the discharge process to fill the space in the casing (10) is discharged outside the casing (10). When the rotary compressor is used to perform a compression stroke of a refrigeration cycle by circulating a refrigerant, the refrigerant goes through a condensation stroke, an expansion stroke, and an evaporation stroke, and then is sucked again to the compression mechanism (20) for compression.

In the rotary compressor, a volume of the cylinder chamber (25) is alternately increased and decreased during the operation of the compression mechanism (20). The refrigerant is sucked when the volume of the cylinder chamber (25) is increased, and is compressed and discharged when the volume of the cylinder chamber (25) is decreased. In the present invention, the oil is fed to the discharge port (21*b*) in the period from the point in time in the discharge process to when the compression process is started while the compression mechanism (20) is operated. When the discharge process of the compression mechanism (20) is finished, the discharge port (21*b*) is closed by the discharge valve (28*a*). Thus, the oil is kept contained in the discharge port (21*b*) until the following compression process is started. Then, the oil in the discharge port (21*b*) flows into the cylinder chamber (25) when the next compression process is started. The oil does not expand even when the pressure in the cylinder chamber (25) is reduced, and the compression process is started. This can reduce the occurrence of pulsation.

In a second aspect of the invention related to the first aspect of the invention, the oil feed path (40) is configured to feed the oil to the inside of the discharge port (21*b*) in a period from the point in time in the discharge process to when the discharge process is finished.

According to the second aspect of the invention, the oil is present in the discharge port (21*b*) when the discharge process is finished. The oil in the discharge port (21*b*) flows into the cylinder chamber (25) when the next compression process is started. This can prevent the occurrence of the pulsation even when the pressure in the cylinder chamber (25) is reduced, and the next compression process is started.

In a third aspect of the invention related to the first aspect of the invention, the oil feed path (40) is configured to feed the oil to the inside of the discharge port (21*b*) in a period from when the discharge process is finished to when the compression process is started.

According to the third aspect of the invention, the oil in the discharge port (21*b*) flows into the cylinder chamber (25) when the compression process is started after the discharge process is finished. Since the oil in the discharge port (21*b*) flows into the cylinder chamber (25), the occurrence of the pulsation can be reduced even when the pressure in the cylinder chamber (25) is reduced, and the next compression process is started.

In a fourth aspect of the invention related to the first aspect of the invention, a single cycle of operation of the compression mechanism (20) is a 360° rotation, and provided that a reference position for the rotation lies between a position at which the discharge process of the compression mechanism (20) is finished, and a position at which the compression process of the compression mechanism (20) is started, and a rotation angle of the reference point is 0°, the oil feed path (40) is configured to feed the oil to the inside of the discharge port (21*b*) when the rotation angle is in a range between 315° and 45°.

The rotation angle in the above range corresponds to the period from the point in time in the discharge process to when the following compression process is started while the compression mechanism (20) is operated. Thus, in the same manner according to the first to third aspects of the invention, the oil in the discharge port (21*b*) flows into the cylinder chamber (25) when the compression process is started after the discharge process is finished. This can prevent the occurrence of the pulsation even when the pressure in the cylinder chamber (25) is reduced, and the next compression process is started.

In a fifth aspect of the invention related to any one of the first to fourth aspects of the invention, the oil feed path (40) includes a direct oil feed path (40A) which communicates with an oil sump (14) provided in the casing (10) and the discharge port (21*b*) to feed the oil from the oil sump (14) to the discharge port (21*b*).

According to the fifth aspect of the invention, the oil is fed from the oil sump (14) to the discharge port (21*b*) of the compression mechanism (20) through the direct oil feed path (40A) while the compression mechanism (20) is operated. Then, the oil present in the discharge port (21*b*) when the discharge process is finished flows into the low pressure cylinder chamber (25) when the compression process of the compression mechanism (20) is started. This can reduce the occurrence of the pulsation due to the re-expansion of the high pressure gas.

In a sixth aspect of the invention related to the fifth aspect of the invention, the rotary compressor further includes: an oil stirring mechanism (50) for stirring the oil contained in the oil sump (14) in accordance with the rotation of the compression mechanism (20).

According to the sixth aspect of the invention, a refrigerant dissolved in the oil is foamed, and is separated from the oil by stirring the oil contained in the oil sump (14). Thus, the oil in which almost no refrigerant is dissolved is fed to the discharge port (21*b*).

In a seventh aspect of the invention related to any one of the first to sixth aspects of the invention, the compression mechanism (20) is formed with a rotary compression mechanism (20) including a piston (26) which revolves in a cylinder (21) along an inner peripheral surface of the cylinder chamber (25) when a crank shaft (33) having an eccentric part (33*b*) is rotated, the oil feed path (40) includes a recess (42) which is formed in the eccentric part (33*b*) of the crank shaft (33), and in which the oil is introduced, and the recess (42) is configured to communicate with the discharge port (21*b*) of the compression mechanism (20) when a rotation angle is in a range where the oil is fed to the inside of the discharge port (21*b*).

According to the seventh aspect of the invention, the crank shaft (33) is rotated, and the piston (26) revolves in the cylinder chamber (25) while the piston compression mechanism (20) is operated. At this time, the recess (42) formed in the eccentric part (33*b*) of the crank shaft (33) also revolves about the center of the crank shaft (33), and the recess (42) communicates with the discharge port (21*b*) of the compression mechanism (20) in the above-described range of the rotation angle. Since the oil is introduced to the recess (42), the oil flows from the recess (42) to the discharge port (21*b*) when the recess (42) communicates with the discharge port (21*b*). Thus, the oil present in the discharge port (21*b*) at this time is introduced to the cylinder chamber (25) when the compression process of the compression mechanism (20) is started.

In an eighth aspect of the invention related to the seventh aspect of the invention, the discharge port (21*b*) is formed with a through hole which is formed in the compression mechanism (20) to partially overlap the recess (42) when the rotation angle is in the range where the oil is fed to the inside of the discharge port (21*b*).

According to the eighth aspect of the invention, the discharge port (21*b*) is formed to partially overlap the revolving recess (42) when the rotation angle is in the range where the oil is fed to the inside of the discharge port (21*b*). Thus, the recess (42) communicates with the discharge port (21*b*) in the above-described range of the rotation angle while the compression mechanism (20) is operated. Since the oil is introduced to the recess (42), the oil flows from the recess (42) to the discharge port (21*b*). Thus, the oil present in the discharge port (21*b*) when the discharge process is finished is introduced to the low pressure cylinder chamber (25) when the compression process of the compression mechanism (20) is started.

In a ninth aspect of the invention related to the seventh aspect of the invention, the discharge port (21*b*) is formed with a through hole which is shifted radially outward from an orbit in which the recess (42) revolves, and a notch (43) through which the discharge port (21*b*) communicates with the recess (42) when the rotation angle is in the range where the oil is fed to the inside of the discharge port (21*b*) is formed in an end face of the piston (26).

According to the ninth aspect of the invention, the discharge port (21*b*) is formed with the through hole which is shifted radially outward from the orbit in which the recess (42) revolves, and the notch (43) through which the discharge port (21*b*) communicates with the recess (42) when the rotation angle is in the range where the oil is fed to the inside of the discharge port (21*b*) is formed in the end face of the piston (26). Thus, while the compression mechanism (20) is operated, the recess (42) communicates with the discharge port (21*b*) in a predetermined range of the rotation angle of the recess (42) revolving about the center of the crank shaft (33). Since the oil is introduced to the recess (42), the oil flows from the recess (42) to the discharge port (21*b*). Thus, the oil present in the discharge port (21*b*) when the discharge process is finished is introduced to the low pressure cylinder chamber (25) when the compression process of the compression mechanism (20) is started.

In a tenth aspect of the invention related to the seventh aspect of the invention, the discharge port (21*b*) is formed with a through hole which is shifted radially outward from an orbit in which the recess (42) revolves, and a notch (44) through which the discharge port (21*b*) communicates with the recess (42) when the rotation angle is in the range where the oil is fed to the inside of the discharge port (21*b*) is formed in the discharge port (21*b*).

According to the tenth aspect of the invention, the discharge port (21*b*) is formed with the through hole which is shifted radially outward from the orbit in which the recess (42) revolves, and the notch (44) through which the discharge port (21*b*) communicates with the recess (42) when the rotation angle is in the range where the oil is fed to the inside of the discharge port (21*b*) is formed in the discharge port (21*b*). Thus, while the compression mechanism (20) is operated, the recess (42) communicates with the discharge port (21*b*) in a predetermined range of the rotation angle of the recess (42) revolving about the center of the crank shaft (33). Since the oil is introduced to the recess (42), the oil flows from the recess (42) to the discharge port (21*b*). Thus, the oil present in the discharge port (21*b*) when the discharge process is finished is introduced to the low pressure cylinder chamber (25) when the compression process of the compression mechanism (20) is started.

In an eleventh aspect of the invention related to any one of the first to fourth aspects of the invention, the oil feed path (40) includes an indirect oil feed path (40B) for intermittently feeding the oil from an oil sump (14) provided in the casing (10) to the discharge port (21*b*) through the inside of the compression mechanism (20) (through sliding surfaces and/or the cylinder chamber (25)).

According to the eleventh aspect of the invention, the oil feed path (40) introduces the oil from the oil sump (14) provided in the casing (10) to the inside of the compression mechanism (20) (the sliding surfaces and the cylinder chamber (25)) while the compression mechanism (20) is operated. The oil is intermittently pushed into the inside of the discharge port (21*b*) from the inside of the compression mechanism (20) while the compression mechanism (20) is operated. Thus, the oil is present in the discharge port (21*b*) in the period from when the discharge process is finished to when the next compression process is started. Since the oil is introduced to the discharge port (21*b*) through the inside of the compression mechanism (20), the oil feed path (40) functions as the indirect oil feed path (40B). The oil present in the discharge port (21*b*) when the discharge process is finished is introduced to the low pressure cylinder chamber (25) when the compression process of the compression mechanism (20) is started.

In a twelfth aspect of the invention related to the eleventh aspect of the invention, the rotary compressor further includes: an oil stirring mechanism (50) for stirring the oil contained in the oil sump (14) in accordance with the rotation of the compression mechanism (20).

According to the twelfth aspect of the invention, a refrigerant dissolved in the oil is foamed, and is separated from the oil by stirring the oil contained in the oil sump (14). Thus, the oil in which almost no refrigerant is dissolved is fed to the discharge port (21*b*).

In a thirteenth aspect of the invention related to the eleventh aspect of the invention, the compression mechanism (20) includes a communicating groove (45) having an end which is opened in a sliding surface of the compression mechanism (20), and the other end which is opened in the cylinder chamber (25) when a rotation angle is in a predetermined range corresponding to a period between the compression process and the discharge process to introduce the oil fed to the sliding surface of the compression mechanism (20) to the cylinder chamber (25) in the predetermined range of the rotation angle.

According to the thirteenth aspect of the invention, while the compression mechanism (20) is operated, the sliding surface of the compression mechanism (20) communicates with the cylinder chamber (25) through the communicating groove (45) in the predetermined range of the rotation angle corresponding to the period between the compression process and the discharge process, thereby feeding the oil from the sliding surface to the cylinder chamber (25). The oil is pushed into the discharge port (21*b*) as the volume of the cylinder chamber (25) is reduced. Thus, the oil is present in the discharge port (21*b*) when the compression process is started after the discharge process is finished. Since the oil is introduced to the discharge port (21*b*) in this way, the oil feed path (40) functions as the indirect oil feed path (40B). Thus, the oil present in the discharge port (21*b*) when the discharge process is finished is introduced to the low pressure cylinder chamber (25) when the compression process of the compression mechanism (20) is started.

In a fourteenth aspect of the invention related to the eleventh aspect of the invention, the compression mechanism (20) includes an oil containing recess (46) which is formed in an inner wall surface of the cylinder chamber (25) to temporarily contain the oil fed from the oil sump (14) to the cylinder chamber (25).

According to the fourteenth aspect of the invention, while the compression mechanism (20) is operated, the oil is introduced from the oil sump (14) provided in the casing (10) to the cylinder chamber (25) of the compression mechanism (20) through the oil feed path (40), and the oil is contained in the oil containing recess (46). The oil in the oil containing recess (46) is pushed into the discharge port (21*b*), which is the only destination of the oil, when the volume of the cylinder chamber (25) is reduced. Thus, the oil is present in the discharge port (21*b*) in the period from when the discharge process is finished to when the next compression process is started. Since the oil is introduced to the discharge port (21*b*) through the cylinder chamber (25), the oil feed path (40) functions as the indirect oil feed path (40B). The oil present in the discharge port (21*b*) when the discharge process is finished is introduced to the low pressure cylinder chamber (25) when the compression process of the compression mechanism (20) is started.

In a fifteenth aspect of the invention related to the fourteenth aspect of the invention, the compression mechanism (20) is formed with a rotary compression mechanism (20) including a suction port (21*a*), a discharge port (21*b*), and a piston (26) which revolves in a cylinder (21) along an inner peripheral surface of the cylinder chamber (25) when a crank shaft (33) having an eccentric part (33*b*) is rotated, and the oil containing recess (46) is formed in an axial end face of the cylinder chamber (25) to be opened/closed by the piston (26) in such a manner that the oil containing recess (46) is exposed from an end face of the piston (26) in the period from when the discharge process is finished to when the compression process is started, is covered with the end face of the piston (26) before the discharge process is started, and communicates with sliding surfaces of the crank shaft (33) and the piston (26) during the discharge process.

According to the fifteenth aspect of the invention, the position of the oil containing recess (46) is determined. Thus, the oil containing recess (46) is covered with the end face of the piston (26) when the discharge process is started, and the oil containing recess (46) communicates with the sliding surfaces of the crank shaft (33) and the piston (26) in the discharge process to contain the oil therein. The oil is then discharged to the cylinder chamber (25) when the suction port (21*a*) is completely closed. The oil is contained in the discharge port (21*b*) as the compression process proceeds. Thus, the oil present in the discharge port (21*b*) when the discharge process is finished is introduced to the low pressure cylinder chamber (25) when the compression process of the compression mechanism (20) is started.

In a sixteenth aspect of the invention related to the eleventh aspect of the invention, an oil introducing hole (47) through which the oil sump (14) in the casing (10) communicates with the cylinder chamber (25) of the compression mechanism (20) is formed in the cylinder (21) of the compression mechanism (20).

According to the sixteenth aspect of the invention, the oil is introduced from the oil sump (14) provided in the casing (10) to the cylinder chamber (25) of the compression mechanism (20) through the oil introducing hole (47). The oil introduced to the cylinder chamber (25) is pushed into the discharge port (21*b*), which is the only destination of the oil, when the volume of the cylinder chamber (25) is reduced. Thus, the oil is present in the discharge port (21*b*) in the period from when the discharge process is finished to when the next compression process is started. Since the oil is introduced to the discharge port (21*b*) through the cylinder chamber (25), the oil feed path (40) functions as the indirect oil feed path (40B). When the compression process of the compression mechanism (20) is started, the oil present in the discharge port (21*b*) at this time is introduced to the low pressure cylinder chamber (25).

In a seventeenth aspect of the invention related to the eleventh aspect of the invention, the compression mechanism (20) is formed with a swing compressor including a piston (26) and a blade (26*b*) which are integrated to form a swing piston (26), and a suction port (21*a*) and a discharge port (21*b*) which are arranged to sandwich the blade (26*b*), and a slit (48) through which a back pressure chamber formed on a back surface of the blade (26*b*) communicates with the cylinder chamber (25) is formed in a side surface of the blade (26*b*) closer to the discharge port (21*b*).

According to the seventeenth aspect of the invention, the oil is introduced from the back pressure chamber to the discharge port (21*b*) through the slit (48). Thus, the oil is present in the discharge port (21*b*) in the period from when the discharge process is finished to when the next compression process is started. Since the oil is introduced to the discharge port (21*b*) through the cylinder chamber (25), the oil feed path (40) functions as the indirect oil feed path (40B). The oil present in the discharge port (21*b*) when the discharge process is finished is introduced to the low pressure cylinder chamber (25) when the compression process of the compression mechanism (20) is started.

Advantages of the Invention

According to the present invention, when the compression process of the compression mechanism (20) is started, the oil in the discharge port (21*b*) flows into the cylinder chamber (25) of the compression mechanism (20), and the oil does not expand at this time. This can reduce the occurrence of the pulsation due to the re-expansion. According to the invention, the oil is fed to the discharge port (21*b*), thereby preventing excessive feeding of the oil to the cylinder chamber where the compression process is started. Still according to the invention, the oil is introduced to the discharge port (21*b*) in the period from the point in time in the discharge process to when the compression process is started, and the lubricant oil fed to the compression mechanism can be used as the oil to be introduced to the discharge port (21*b*). This can simplify the configuration, and can reduce the cost of the compressor.

According to the second to fourth aspects of the invention, as described above, the oil in the discharge port (21*b*) flows into the cylinder chamber (25) when the compression process is started, and the occurrence of the pulsation in the low pressure cylinder chamber (25) can be reduced. This can also prevent the excessive feeding of the oil to the cylinder chamber where the compression process is started. Use of the lubricant oil fed to the compression mechanism can simplify the configuration, and can reduce the cost of the compressor.

According to the fifth aspect of the invention, while the compression mechanism (20) is operated, the oil fed from the oil sump (14) to the discharge port (21*b*) of the compression mechanism (20) through the direct oil feed path (40A) flows into the cylinder chamber (25) when the compression process of the compression mechanism (20) is started. Thus, the occurrence of the pulsation due to the re-expansion of the high pressure gas can be reduced. This can simplifies the configuration in the same manner as the first to fourth aspects of the invention, and can prevent the excessive feeding of the oil to the cylinder chamber (25).

According to the sixth aspect of the invention, the refrigerant dissolved in the oil is foamed, and is separated from the oil by stirring the oil contained in the oil sump (14). Thus, the oil in which almost no refrigerant is dissolved is fed to the discharge port (21*b*). This can reduce the refrigerant flowing from the discharge port (21*b*) to the cylinder chamber (25) when the compression process is started, thereby effectively reducing the occurrence of the pulsation.

According to the seventh aspect of the invention, while the compression mechanism (20) is operated, the recess (42) formed in the eccentric part (33*b*) of the crank shaft (33) revolves about the center of the crank shaft (33), and the recess (42) communicates with the discharge port (21*b*) of the compression mechanism (20) in the above-described range of the rotation angle. Since the oil is introduced to the recess (42), the oil flows from the recess (42) to the discharge port (21*b*) when the recess (42) communicates with the discharge port (21*b*). Thus, the oil present in the discharge port (21*b*) is introduced to the low pressure cylinder chamber (25) when the compression process of the compression mechanism (20) is started. Thus, according to the present invention, the recess (42) to which the oil is introduced is configured to communicate with the discharge port (21*b*). This simple configuration can reduce the occurrence of the pulsation due to the re-expansion of the high pressure gas.

According to the eighth aspect of the invention, the discharge port (21*b*) is formed to partially overlap the recess (42) when the rotation angle is in the range where the oil is fed to the inside of the discharge port (21*b*), and the recess (42) communicates with the discharge port (21*b*) in the above-described range of the rotation angle while the compression mechanism (20) is operated. Since the oil is introduced to the recess (42), the oil flows from the recess (42) to the discharge port (21*b*). Thus, the oil present in the discharge port (21*b*) when the discharge process is finished is introduced to the low pressure cylinder chamber (25) when the compression process of the compression mechanism (20) is started. The simple configuration, i.e., forming the recess (42) in the eccentric part (33*b*) of the crank shaft (33), can reduce the occurrence of the pulsation due to the re-expansion of the high pressure gas.

According to the ninth aspect of the invention, the discharge port (21*b*) is formed with the through hole which is shifted radially outward from the orbit in which the recess (42) revolves, and the notch (43) through which the discharge port (21*b*) communicates with the recess (42) when the rotation angle is in the range where the oil is fed to the inside of the discharge port (21*b*) is formed in the end face of the piston (26). Thus, when the recess (42) revolves about the center of the crank shaft (33) while the compression mechanism (20) is operated, the recess (42) communicates with the discharge port (21*b*) in the above-described range of the rotation. Since the oil is introduced to the recess (42), the oil flows from the recess (42) to the discharge port (21*b*). Thus, the oil present in the discharge port (21*b*) when the discharge process is finished is introduced to the low pressure cylinder chamber (25) when the compression process of the compression mechanism (20) is started. The simple configuration, i.e., forming the recess (42) in the eccentric part (33*b*) of the crank shaft (33), and communicating the recess (42) with the discharge port (21*b*) through the notch (43) when the oil is fed to the inside of the discharge port (21*b*), can reduce the occurrence of the pulsation due to the re-expansion of the high pressure gas.

According to the tenth aspect of the invention, the discharge port (21*b*) is formed with the through hole which is shifted radially outward from the orbit in which the recess (42) revolves, and the notch (44) through which the discharge port (21*b*) communicates with the recess (42) when the rotation angle is in the range where the oil is fed to the inside of the discharge port (21*b*) is formed in the discharge port (21*b*). Thus, when the recess (42) revolves about the center of the crank shaft (33) while the compression mechanism (20) is operated, the recess (42) communicates with the discharge port (21*b*) in the above-described range of the rotation. Since the oil is introduced to the recess (42), the oil flows from the recess (42) to the discharge port (21*b*). Thus, the oil present in the discharge port (21*b*) when the discharge process is finished is introduced to the low pressure cylinder chamber (25) when the compression process of the compression mechanism (20) is started. The simple configuration, i.e., forming the recess (42) in the eccentric part (33*b*) of the crank shaft (33), and communicating the recess (42) with the discharge port (21*b*) through the notch (44) in the range of the rotation angle where the oil is fed to the inside of the discharge port (21*b*), can reduce the occurrence of the pulsation due to the re-expansion of the high pressure gas.

According to the eighth to tenth aspects of the invention, the recess (42) is formed only in part of the periphery of the eccentric part in such a manner that discharge port (21*b*) and the recess (42) communicate with each other in the range of the rotation angle where the oil is fed to the inside of the discharge port (21*b*) of the compression mechanism (20). Thus, the oil can intermittently be fed to the discharge port (21*b*).

According to the eleventh aspect of the invention, while the compression mechanism (20) is operated, the oil is fed from the oil sump (14) provided in the casing (10) to the inside of the compression mechanism (20) (the sliding surfaces and the cylinder chamber (25)) through the oil feed path (40). The oil is intermittently pushed into the discharge port (21*b*) in accordance with the operation of the compression mechanism (20). Thus, the oil is present in the discharge port (21*b*) in the period from when the discharge process is finished to when the next compression process is started. Since the oil is introduced to the discharge port (21*b*) through the inside of the compression mechanism (20), the oil feed path (40) functions as the indirect oil feed path (40B). The oil present in the discharge port (21*b*) when the discharge process is finished is introduced to the low pressure cylinder chamber (25) when the compression process of the compression mechanism (20) is started. The simple configuration, i.e., introducing the oil to the discharge port (21*b*) through the cylinder chamber (25), can reduce the occurrence of the pulsation due to the re-expansion of the high pressure gas.

According to the twelfth aspect of the invention, the refrigerant dissolved in the oil is foamed, and is separated from the oil by stirring the oil contained in the oil sump (14), thereby feeding the oil in which almost no refrigerant is dissolved to the discharge port (21*b*). This can reduce the refrigerant flowing from the discharge port (21*b*) to the cylinder chamber (25) when the compression process is started, thereby effectively reducing the occurrence of the pulsation.

According to the thirteenth aspect of the invention, while the compression mechanism (20) is operated, the sliding surface of the compression mechanism (20) communicates with the cylinder chamber (25) through the communicating groove (45) in the predetermined range of the rotation angle corresponding to the period between the compression process and the discharge process, thereby feeding the oil from the sliding surface to the cylinder chamber (25). The oil is pushed into the discharge port (21*b*) as the volume of the cylinder chamber (25) is reduced. Thus, the oil is present in the discharge port (21*b*) in the period from when the discharge process is finished to when the next compression process is started. Since the oil is introduced to the discharge port (21*b*) in this way, the oil feed path (40) functions as the indirect oil feed path (40B). When the compression process of the compression mechanism (20) is started, the oil present in the discharge port (21*b*) at this time is introduced to the low pressure cylinder chamber (25). The simple configuration, i.e., introducing the oil to the cylinder chamber (25) through the communicating groove (45), can reduce the occurrence of the pulsation due to the re-expansion of the high pressure gas.

According to the fourteenth aspect of the invention, while the compression mechanism (20) is operated, the oil is introduced from the oil sump (14) provided in the casing (10) to the cylinder chamber (25) of the compression mechanism (20) through the oil feed path (40), and the oil is contained in the oil containing recess (46). The oil in the oil containing recess (46) is pushed into the discharge port (21*b*), which is the only destination of the oil, when the volume of the cylinder chamber (25) is reduced. Thus, the oil is present in the discharge port (21*b*) in the period from when the discharge process is finished to when the next compression process is started. Since the oil is introduced to the discharge port (21*b*) through the cylinder chamber (25), the oil feed path (40) functions as the indirect oil feed path (40B). When the compression process of the compression mechanism (20) is started, the oil present in the discharge port (21*b*) at this time is introduced to the low pressure cylinder chamber (25). The simple configuration, i.e., introducing the oil to the cylinder chamber (25), and containing the oil in the oil containing recess, can reduce the occurrence of the pulsation due to the re-expansion of the high pressure gas.

According to the fifteenth aspect of the invention, the oil which is discharged in the cylinder chamber (25) when the suction port (21*a*) is completely closed is contained in the discharge port (21*b*) as the compression process proceeds. When the compression process of the compression mechanism (20) is started, the oil present in the discharge port (21*b*) at this time is introduced to the low pressure cylinder chamber (25). This can reduce the occurrence of the pulsation due to the re-expansion of the high pressure gas.

According to the sixteenth aspect of the invention, while the compression mechanism (20) is operated, the oil is introduced from the oil sump (14) provided in the casing (10) to the cylinder chamber (25) of the compression mechanism (20) through the oil introducing hole (47). The oil introduced to the cylinder chamber (25) is pushed into the discharge port (21*b*), which is the only destination of the oil, when the volume of the cylinder chamber (25) is reduced. Thus, the oil is present in the discharge port (21*b*) in the period from when the discharge process is finished to when the next compression process is started. Since the oil is introduced to the discharge port (21*b*) through the cylinder chamber (25), the oil feed path (40) functions as the indirect oil feed path (40B). The oil present in the discharge port (21*b*) when the discharge process is finished is introduced to the low pressure cylinder chamber (25) when the compression process of the compression mechanism (20) is started. The simple configuration, i.e., introducing the oil to the cylinder chamber (25) through the oil introducing hole (47), can reduce the occurrence of the pulsation due to the re-expansion of the high pressure gas.

According to the seventeenth aspect of the invention, while the compression mechanism (20) is operated, the oil is introduced from the back pressure chamber to the discharge port (21*b*) through the slit (48). Thus, the oil is present in the discharge port (21*b*) in the period from when the discharge process is finished to when the next compression process is started. Since the oil is introduced to the discharge port (21*b*) through the cylinder chamber (25), the oil feed path (40) functions as the indirect oil feed path (40B). When the compression process of the compression mechanism (20) is started, the oil present in the discharge port (21*b*) at this time is introduced to the low pressure cylinder chamber (25). The simple configuration, i.e., introducing the oil to the discharge port (21*b*) through the slit (48), can reduce the occurrence of the pulsation due to the re-expansion of the high pressure gas.

According to the fourteenth to seventeenth aspects of the invention, the oil is not directly introduced from the oil sump (14) to the cylinder chamber (25) after the suction port is completely closed, but is introduced to the cylinder chamber (25) through the discharge port (21*b*). This can prevent excessive feeding of the oil to the cylinder chamber.

BRIEF DESCRIPTION OF THE DRAWINGS

FIG. 4(A) is a vertical cross-sectional view illustrating a major part of the rotary compressor, and FIG. 4(B) shows an internal structure of a compression mechanism.

FIG. 5(A) is a vertical cross-sectional view illustrating a major part of the rotary compressor, and FIG. 5(B) shows an internal structure of a compression mechanism.

FIG. 6(A) is a vertical cross-sectional view illustrating a major part of the rotary compressor, and FIG. 6(B) shows an internal structure of a compression mechanism.

FIG. 7(A) is a vertical cross-sectional view illustrating a major part of the rotary compressor, FIG. 7(B) shows an internal structure of a compressor mechanism in a first state, and FIG. 7(C) shows an internal structure of the compressor mechanism in a second state.

FIG. 9(A) is a vertical cross-sectional view illustrating a major part of the rotary compressor, and FIG. 9(B) shows an internal structure of a compression mechanism.

FIG. 10(A) is a vertical cross-sectional view illustrating a major part of the rotary compressor, and FIG. 10(B) shows an internal structure of a compression mechanism.

FIG. 11(A) is a vertical cross-sectional view illustrating a major part of the rotary compressor, and FIG. 11(B) is a bottom view partially illustrating a compression mechanism.

DESCRIPTION OF EMBODIMENTS

Embodiments of the present invention will be described in detail with reference to the drawings.

First Embodiment of the Invention

Figure 1:
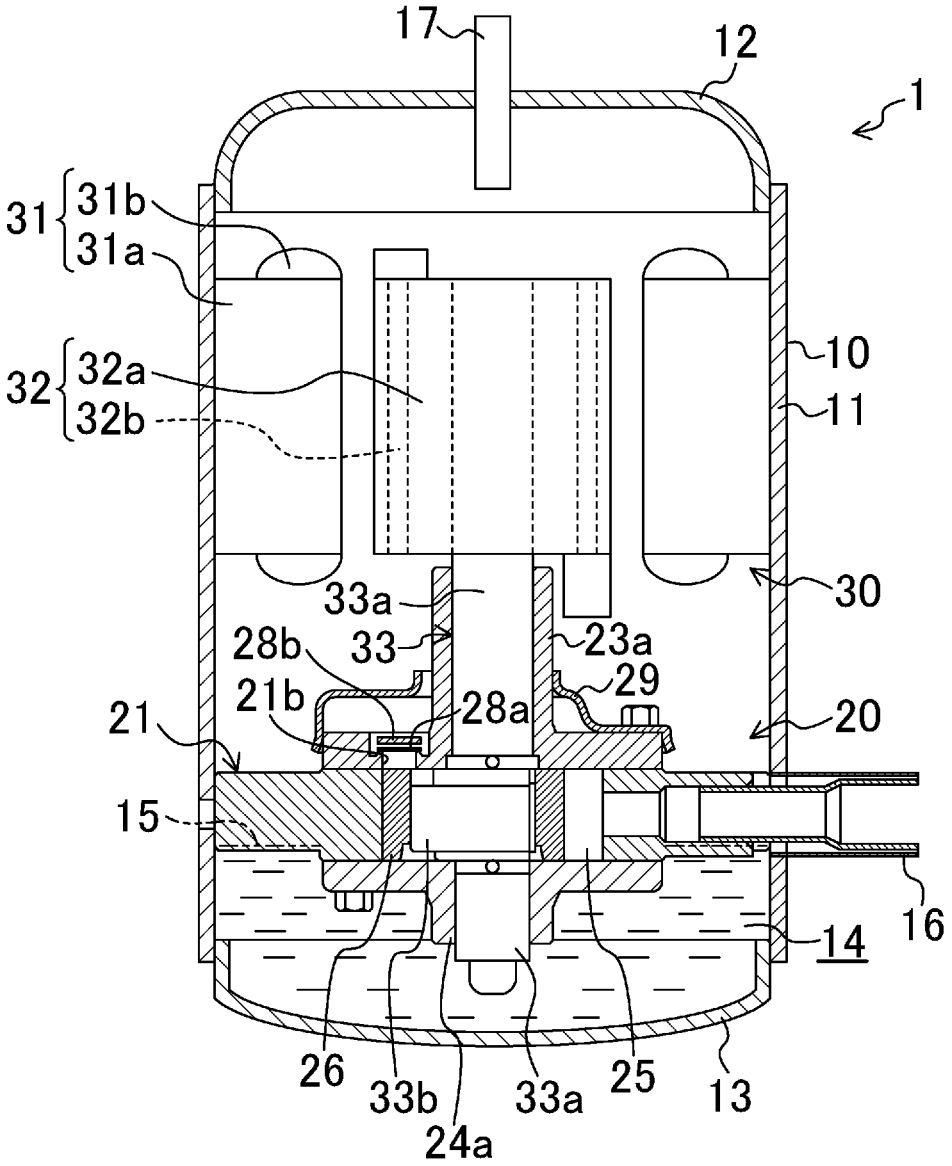
FIG. 1 is a vertical cross-sectional view of a rotary compressor according to a first embodiment of the present invention.

FIG. 1 is a vertical cross-sectional view illustrating a rotary compressor (1) according to a first embodiment. The compressor (1) performs a compression stroke for compressing a refrigerant in a vapor compression refrigeration cycle. As shown in the drawings, the compressor (1) includes a casing (10) in the shape of a vertical cylinder, and a compression mechanism (20) and a drive mechanism (30) arranged in the casing (10). The compression mechanism (20) is arranged in a lower part in the casing (10), and the drive mechanism (30) is arranged in an upper part in the casing (10). The drive mechanism (30) is formed with an electric motor for driving the compression mechanism (20).

The casing (10) includes a barrel (11) which is in the shape of a vertical cylinder having upper and lower open ends, an upper end plate (12) fixed to the barrel (11) to close the upper opening of the barrel (11), and a lower end plate (13) fixed to the barrel (11) to close the lower opening of the barrel (11). An oil sump (14) for containing oil (refrigeration machine oil) is formed in a lower end of the casing (10). Oil level (15) of the oil sump (14) is determined at a height where a lower part of the compression mechanism (20) is immersed in the oil.

A suction pipe (16) is provided in a lower part of the barrel (11) of the casing (10) to correspond to the compression mechanism (20). A discharge pipe (17) is provided substantially in the center of the upper end plate (12) of the casing (10) to pass along a center line of the casing (10) extending in an axial direction thereof. The compressor (1) is configured as a high pressure dome type compressor (1) which discharges high pressure gas discharged from the compression mechanism (20) outside the casing (10) through space in the casing (10).

The electric motor (30) includes a stator (31) and a rotor (32). The stator (31) includes a cylindrical stator core (31*a*) formed by stacking electromagnetic steel sheets, and a coil (31*b*) wound around the stator core (31*a*). An outer peripheral surface of the stator core (31*a*) of the stator (31) is fixed to the barrel (11) by welding or shrink-fitting above the compression mechanism (20) in the barrel (11) of the casing (10). The rotor (32) includes a rotor core (32*a*) formed by stacking electromagnetic steel sheets, and a permanent magnet (32*b*) attached to the rotor core (32*a*). The rotor (32) is arranged inside the stator (31) to form a uniform and fine radial gap between an outer peripheral surface of the rotor (32) and an inner peripheral surface of the stator (31) (the gap is exaggerated in the drawing).

A drive shaft (33) (a crank shaft) is fixed to an inner peripheral surface of the rotor (32). The drive shaft (33) includes a main shaft (33*a*), and an eccentric part (33*b*) formed below the center of the main shaft (33*a*) in the axial direction. A diameter of the eccentric part (33*b*) is larger than a diameter of the main shaft (33*a*), and the center of the eccentric part (33*b*) is eccentric from the center of the main shaft (33*a*).

The compression mechanism (20) is formed with a swing compression mechanism (20), which is one of revolving compression mechanisms. FIG. 2(A) is a vertical cross-sectional view illustrating a major part of the compressor (1), particularly illustrating a vertical cross-section of the compression mechanism (20), and FIG. 2(B) shows an inner structure of the compression mechanism (20) when viewed in plan. As shown in the drawings, the compression mechanism (20) includes a cylinder (21) having a cylinder chamber (25), and a swing piston (26) configured to be able to revolve in the cylinder chamber (25) along an inner peripheral surface of the cylinder chamber (25).

The cylinder (21) includes a substantially annular cylinder body (22) fixed to the barrel (11) of the casing (10), a front head (23) fixed to an upper surface of the cylinder body (22) shown in FIG. 2(A), and a rear head (24) fixed to a lower surface of the cylinder body (22) shown in FIG. 2(A). The front head (23) is fixed to the upper surface of the cylinder body (22) with a fastening member such as a bolt, and the rear head (24) is fixed to the lower surface of the cylinder body (22) with a fastening member such as a bolt. Space defined by the cylinder body (22), the front head (23), and the rear head (24) constitutes the cylinder chamber (25).

The eccentric part (33*b*) of the drive shaft (33) is located in the cylinder chamber (25). The swing piston (26) is attached to the eccentric part (33*b*). The swing piston (26) is slidably fitted to an outer peripheral surface of the eccentric part (33*b*). The front head (23) and the rear head (24) include bearings (23*a*, 24*a*) for rotatably supporting the main shaft (33*a*) of the drive shaft (33), respectively. The swing piston (26) is configured in such a manner that an outer peripheral surface of the swing piston (26) is substantially in contact with an inner peripheral surface of the cylinder chamber (25) with an oil film interposed therebetween when the drive shaft (33) is rotated.

The swing piston (26) is formed by integrating an annular oscillating piston body (26*a*) which is fitted to the eccentric part (33*b*) of the drive shaft (33), and a blade (26*b*) extending radially outward from the oscillating piston body (26*a*). The cylinder body (22) includes a swing bush (27) for supporting the blade (26*b*) in such a manner that the blade (26*b*) is able to swing. The swing bush (27) is formed with a pair of members, each of which is substantially semicircular when viewed in section, and has substantially the same thickness as the cylinder body (22). The paired members are supported in a bush supporting recess (22*a*) formed in the cylinder body (22) with their flat surfaces facing each other. A blade groove (27*a*) is formed between the flat surfaces of the paired members of swing bush (27), and the blade (26*b*) of the swing piston (26) is slidably supported in the blade groove (27*a*). A back pressure chamber is formed radially outside the bush supporting recess (22*a*).

In the above-described configuration, when the drive shaft (33) of the compression mechanism (20) is rotated, the swing bush (27) oscillates, the blade (26*b*) moves back and forth in the blade groove (27*a*) of the swing bush (27), and the swing piston (26) revolves in the cylinder chamber (25) along the inner peripheral surface of the cylinder chamber (25). Thus, the compression mechanism (20) is configured as the above-described swing compression mechanism (20) in which the swing piston (26) revolves in the cylinder (21) while the blade (26*b*) oscillates when the drive shaft (33) having the eccentric part (33*b*) is rotated.

A suction port (21*a*) is formed in the cylinder body (22) of the cylinder (21), and the suction pipe (16) is connected to the suction port (21*a*). A discharge port (21*b*) is formed in the front head (23) of the cylinder (21), and a lower opening of the discharge port (21*b*) is opened in the cylinder chamber (25). A discharge valve (28*a*) which is a reed valve, and a valve guard (28*b*) for controlling a lift of the discharge valve are provided in an upper opening of the discharge port (21*b*). A discharge cover (29) (a discharge muffler) is attached to an upper surface of the front head (23) to cover the discharge port (21*b*). The discharge cover (29) includes a discharge recess (29*a*) formed between an internal end thereof and the bearing (23*a*) of the front head (23).

An oil feed pump (34) which is immersed in the oil in the oil sump (14) is provided at a lower end of the drive shaft (33). The drive shaft (33) includes an oil feed passage (35) extending upward from the oil feed pump (34) along the center of the drive shaft (33) as shown in FIG. 2(A). The oil feed passage (35) is configured to feed the oil to sliding surfaces of the bearings (23*a*, 24*a*) and the drive shaft (33) through a bearing oil feed path (36) extending in a radial direction of the drive shaft (33) at positions above and below the eccentric part (33*b*).

The oil feed passage (35) extends upward from the lower end of the drive shaft (33) to pass through the center of the drive shaft (33). The oil feed passage (35) includes a large-diameter oil supply passage (35*a*) which extends from the lower end of the drive shaft (33) to a position slightly above the eccentric part (33*b*), and a small-diameter degassing passage (35*b*) which extends from an upper end of the oil feed passage (35*a*) to a position slightly above the upper end of the front head (23). A degassing hole (35*c*) is formed in an upper end of the degassing passage (35*b*), and the degassing hole (35*c*) penetrates the drive shaft (33) in the radial direction thereof.

The compressor (1) includes an oil feed path (40) for feeding the oil from the oil sump (14) provided in the casing (10) to the discharge port (21*b*). In the first embodiment, the oil feed path (40) is configured as a direct oil feed path (40A) through which the oil sump (14) directly communicates with the discharge port (21*b*).

The oil feed path (40) is formed by using the oil feed passage (35) in the drive shaft (33). The oil feed path (40) includes a radially-opened oil feed hole (41*a*) which is opened substantially in the center of the eccentric part (33*b*) in the vertical direction, and extends in the radial direction of the eccentric part (33*b*), and an axially-extending slit (41*b*) formed in the outer peripheral surface of the eccentric part (33*b*) of the drive shaft (33) to extend in the axial direction. The eccentric part (33*b*) includes an annular groove (42) (a recess) is formed to communicate with the axially-extending slit (41*b*). The annular groove (42) is formed in each axial end of the eccentric part (33*b*). The annular grooves (42) are originally provided to feed the oil to sliding surfaces of the eccentric part (33*b*) and the swing piston (26).

The discharge port (21*b*) is a through hole which is formed in the compression mechanism (20) to partially overlap the annular groove (42) in a period from a point in time in a discharge process to when a compression process is started while the annular groove (42) (recess) revolves, and has a round cross-section. The discharge port (21*b*) is formed in such a manner that an inner end thereof overlaps the annular groove (42) of the eccentric part (33*b*) when the eccentric part (33*b*) approaches a top dead center (in the period from the point in time in the discharge process to when the compression process is started). Provided that a rotation angle of the piston at the top dead center as shown in FIG. 2(B) is 0°, a range of the rotation angle where the discharge port (21*b*) overlaps the annular groove (42) is from a rotation angle greater than 315° to about 45° in a clockwise direction. In particular, the range of the rotation angle is preferably from a rotation angle greater than 330° to about 20°.

Figure 3:
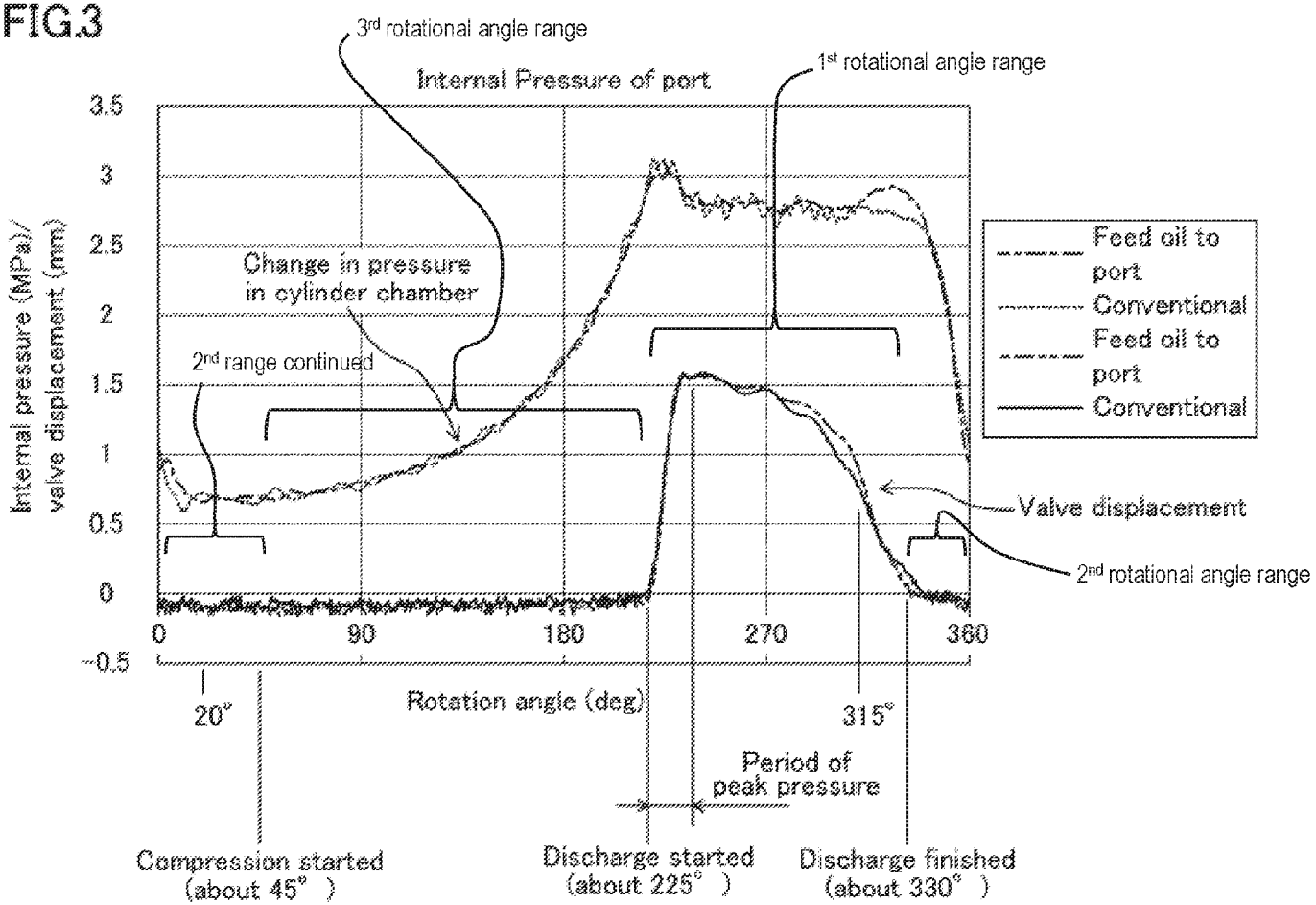
FIG. 3 is a graph illustrating a change in pressure in a cylinder chamber which increases or decreases in response to a change in rotation angle of a piston, and a displacement of a discharge valve.

The range of the rotation angle will be described with reference to a graph of FIG. 3.

The graph indicates a change in pressure in the compression chamber which increases or decreases in accordance with a change in rotation angle of the piston, and a displacement of the discharge valve (valve displacement). A unit of the pressure is MPa, and a unit of the valve displacement is mm. Compression of the refrigerant starts when the suction port (21*a*) is completely closed while the piston is rotated. Provided that the rotation angle of the piston at the top dead center as shown in FIG. 2(B) is 0°, the rotation angle of the piston at this time is about 45° in the clockwise direction. In FIG. 3, "Feed oil to port" designates the compressor of the present embodiment in which the oil is fed to the discharge port (21*b*), and "Conventional" designates a conventional compressor in which the oil is not fed to the discharge port.

As the piston is rotated, a pressure in the cylinder chamber (25) hardly changes until the rotation angle approaches about 90°. The pressure gradually increases for some time after the rotation angle exceeds 90°, and then abruptly increases as the rotation angle increases to about 225°. At the rotation angle about 225°, the discharge valve (28*a*) starts to open, and then immediately opens to the maximum lift by the increased pressure. When the discharge valve (28*a*) opens to the maximum lift, the pressure in the cylinder chamber (25) is once reduced, and the valve is kept open to a constant lift until the rotation angle approaches almost 270°. Then, the valve displacement gradually decreases, during which the pressure in the cylinder chamber (25) is kept almost constant for a certain period. Then, when the piston comes to an angle at which the discharge valve (28*a*) is almost closed (when the rotation angle exceeds 315° and approaches about 330°), the discharge process is substantially finished. When the discharge valve (28*a*) is closed, the pressure in the cylinder chamber (25) is abruptly reduced.

Thus, in the present embodiment, the lubricant oil contained in the bottom of the casing (10) is fed to the inside of the discharge port (21*b*) through the oil feed path (40) in the period from the point in time in the discharge process to when the compression process is started (in the period when the rotation angle of the piston is 315°-45°). The "point in time in the discharge process" indicates a point in time when the pressure in the cylinder chamber (25) is reduced from a peak value. Since a pressure in the discharge port (21*b*) is high immediately after the discharge process is started, the oil is hardly fed to the discharge port even when a structure for feeding the oil to the discharge port is employed. When the discharge pressure is then reduced from the peak value, the oil enters the discharge port (21*b*). Since the oil is fed to the discharge port (21*b*) in the present embodiment, the pressure in the discharge port (21*b*) is once increased, and then reduced abruptly, unlike the conventional compressor in which the pressure is gently reduced when the discharge is finished, and then abruptly reduced.

Since the oil is fed to the discharge port (21*b*) in the period from the point in time in the discharge process to when the compression process is started as described above, the oil is present in the discharge port (21*b*) when the piston passes through the discharge port (21*b*) after the discharge port (21*b*) is closed by the discharge valve (28*a*). Specifically, the oil is present in the discharge port (21*b*) immediately after this event, i.e., when the refrigerant re-expands in the conventional compressor. In a range of the rotation angle where the refrigerant re-expands in the conventional compressor, the refrigerant does not flow into the cylinder chamber (25), and does not re-expand therein in the present embodiment. Instead, the oil flows from the discharge port (21*b*) to the cylinder chamber (25). Since the oil does not expand, the oil flowing to the cylinder chamber (25) does not cause the pulsation.

As described above, the oil feed path (40) is configured to feed the refrigeration machine oil to the inside of the discharge port (21*b*) in the period from the point in time in the discharge process to when the compression process is started. Provided that a cycle of the operation of the compression mechanism (20) is a 360° rotation of the piston, the refrigeration machine oil is intermittently fed to the discharge port (21*b*) merely in a predetermined range of the rotation angle corresponding to the period from the point in time in the discharge process to when the compression process is started. This is because the annular groove (42) formed in the eccentric part (33*b*) of the drive shaft (33) intermittently communicates with the discharge port (21*b*) of the compression mechanism (20) only in the period from the point in time in the discharge process to when the compression process is started.

—Working Mechanism—

A working mechanism of the rotary compressor (1) will be described below.

When the electric motor (30) is operated, the rotor (32) is rotated, and the rotation is transferred to the drive shaft (33). When the drive shaft (33) is rotated, the swing piston (26)

revolves in the cylinder (21) along the inner peripheral surface of the cylinder chamber (25). Thus, a volume of the cylinder chamber (25) is repeatedly increased and reduced. The refrigerant is sucked into the cylinder chamber (25) through the suction port (21*a*) when the volume of the cylinder chamber (25) is increased, and is compressed and discharged to the inside of the casing (10) through the discharge port (21*b*) when the volume of the cylinder chamber (25) is reduced.

The high pressure refrigerant discharged from the cylinder chamber (25) fills the casing (10). The high pressure refrigerant filling the casing (10) flows outside through the discharge pipe (17), and goes through a condensation stroke, an expansion stroke, and an evaporation stroke while circulating in the refrigerant circuit, and is sucked again into the compressor (1) to experience the compression stroke. Thus, the vapor compression refrigeration cycle is performed by the refrigerant circulating in the refrigerant circuit as described above.

When the compression mechanism (20) is operated, the refrigeration machine oil sucked up from the oil sump (14) by the oil feed pump (34) is fed to the bearings (23*a*, 24*a*), thereby reducing increase in sliding resistance between the drive shaft (33) and the bearings (23*a*, 24*a*). Further, the refrigeration machine oil is also fed between the eccentric part (33*b*) and the swing piston (26), thereby reducing increase in sliding resistance therebetween. The oil sucked up by the oil feed pump (34) is fed to the discharge port (21*b*) through the radially-opened oil feed hole (41*a*) and the axially-extending slit (41*b*) of the oil feed path (40), and the annular groove (42) (the recess) of the eccentric part (33*b*) in the period from the point in time in the discharge process to when the compression process is started.

In general, a suction process, a compression process, and a discharge process constitute a single cycle of the operation of the compression mechanism (20). When the discharge process is finished, the swing piston (26) approaches the position near the top dead center as shown in FIG. 2(B). At this time, both ends of the discharge port (21*b*) are closed by the discharge valve (28*a*) and the swing piston (26). Thus, space inside the discharge port (21*b*) is hermetically sealed, in which the high pressure refrigerant remains, i.e., a dead volume from which the high pressure refrigerant cannot be completely discharged is provided. When the next compression process is started in this state, the high pressure refrigerant in the discharge port (21*b*) flows into the low pressure cylinder chamber (25) and re-expands therein, thereby causing pulsation.

In the present embodiment, the high pressure refrigeration machine oil is fed to the discharge port (21*b*) in the period from the point in time in the discharge process to when the compression process is started. This reduces the dead volume in the discharge port (21*b*). When the refrigeration machine oil is contained in the discharge port (21*b*), the refrigeration machine oil flows from the discharge port (21*b*) to the low pressure cylinder chamber (25) when the next compression process is started. At this time, the refrigeration machine oil does not substantially expand, unlike the refrigerant gas. Thus, the pulsation due to the re-expansion can be reduced.

Advantages of First Embodiment

According to the first embodiment described above, the high pressure refrigeration machine oil is fed to the inside of the discharge port (21*b*) in the period from the point in time in the discharge process to when the compression process is started. This can reduce the pulsation of the compression mechanism (20) due to the re-expansion of the high pressure refrigerant. Therefore, vibration and noise caused by the re-expansion can be reduced. The vibration and noise caused by the re-expansion of the high pressure gas remaining in the discharge port (21*b*) can be reduced by a simple configuration of feeding the oil to the discharge port (21*b*) by using the oil feed passage (35). The present embodiment can be achieved by merely shifting the discharge port (21*b*) radially inward, thereby reducing an increase in manufacturing cost as compared with the conventional configuration.

Since the refrigeration machine oil is intermittently fed to the discharge port (21*b*), an excessive amount of the oil is not contained in the discharge port (21*b*). An excessive amount of the refrigeration machine oil contained in the discharge port (21*b*) may affect the discharging of the refrigerant. In the present embodiment, however, the refrigerant is fed to the discharge port (21*b*) only intermittently, which does not have any adverse effect on the discharging of the refrigerant. Since the oil is fed to the inside of the discharge port (21*b*) in the period from the point in time in the discharge process to when the compression process is started, the amount of the oil is stabilized.

The oil flowing through the oil feed passage (35) is stirred in the oil feed passage (35) to foam, thereby reducing solubility of the refrigerant in the oil. Specifically, the operation can be performed with the oil and the refrigerant separated from each other, and efficiency is less reduced.

Alternative of First Embodiment (First Alternative)

Figure 2:
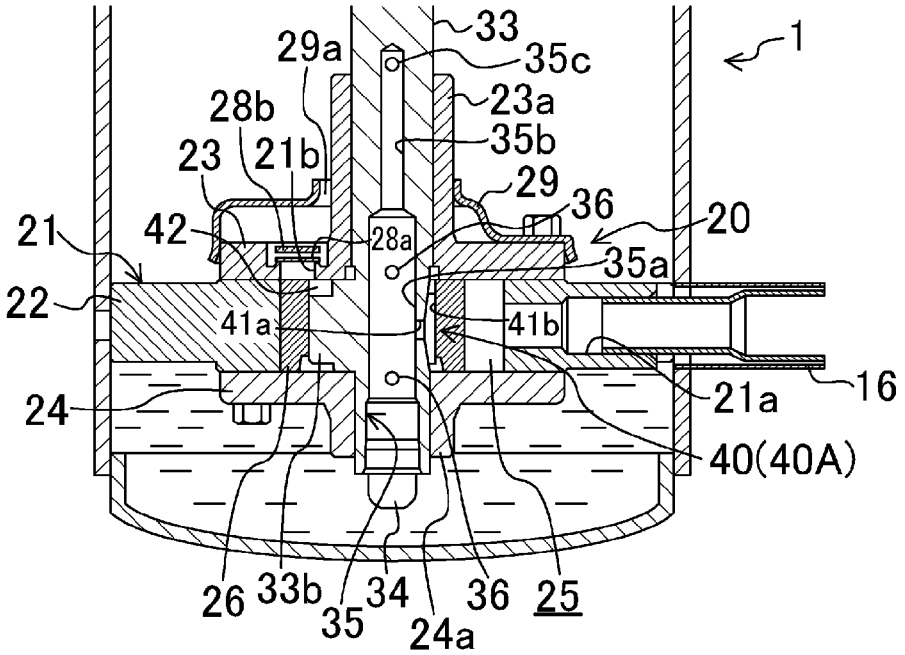
FIG. 2(A) is a cross-sectional view illustrating a major part of the rotary compressor of FIG. 1.
FIG. 2(B) shows an internal structure of a compression mechanism.
Figure 2:
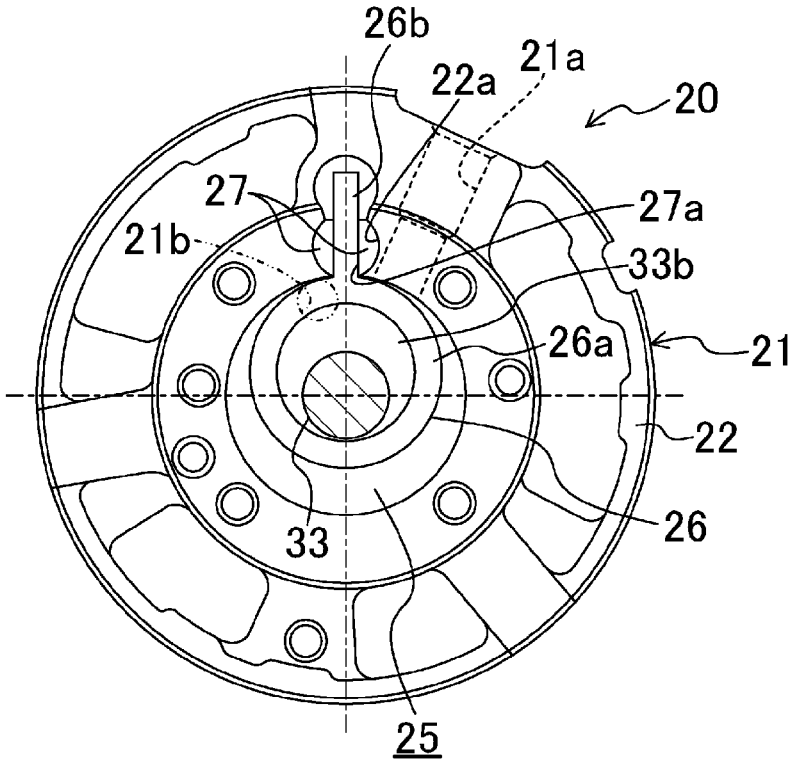
Figure 4:
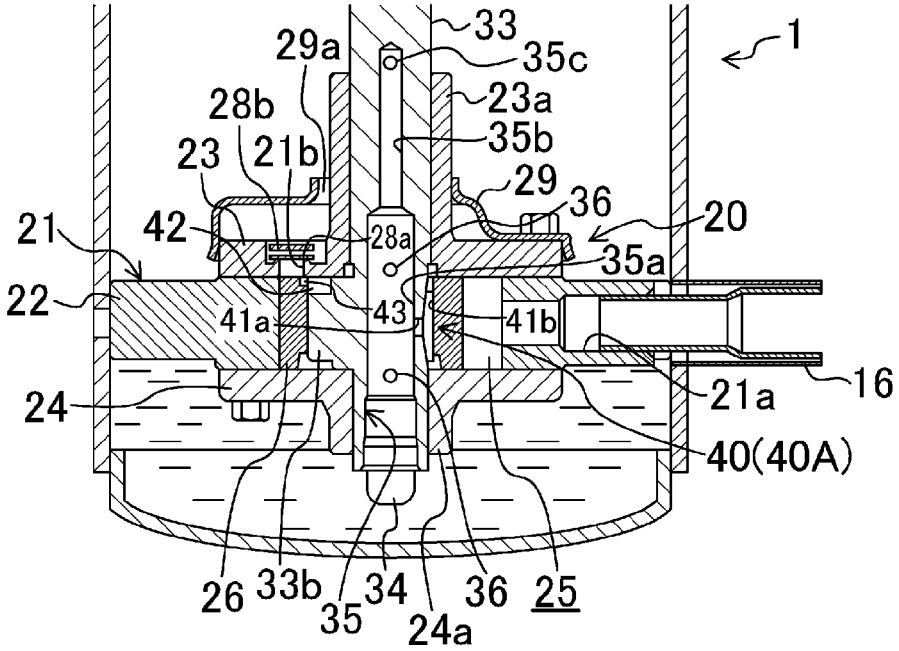
FIGS. 4(A) and 4(B) show a rotary compressor according to a first alternative of the first embodiment.
Figure 4:
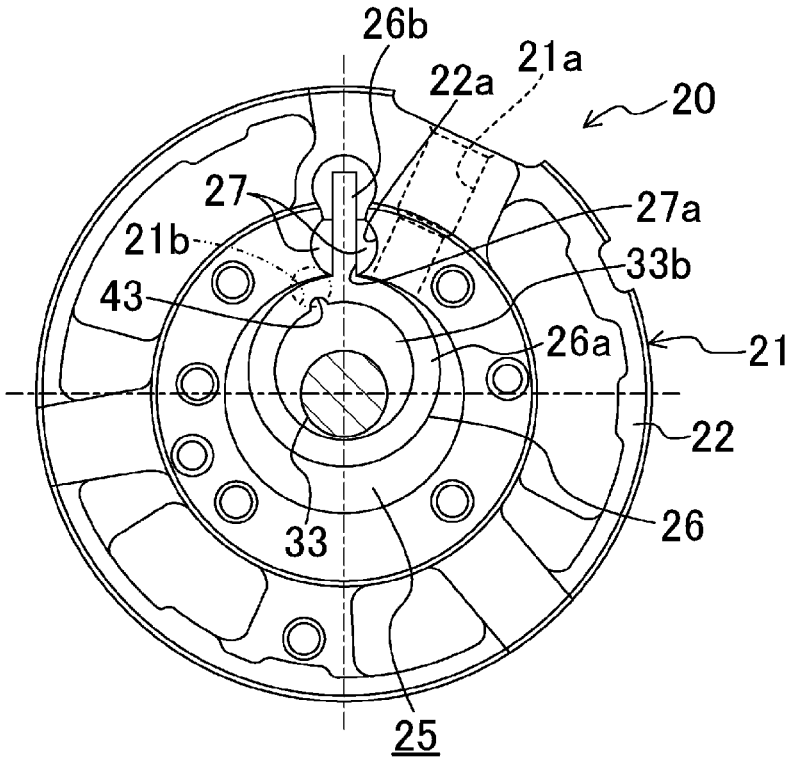

In a first alternative of the first embodiment shown in FIGS. 4(A) and 4(B), the configuration of the oil feed path (40) is different from the example shown in FIGS. 1 and 2.

In the oil feed path (40) according to the first alternative, a notch (43) through which the discharge port (21*b*) communicates with the annular groove (42) of the eccentric part (33*b*) in the period from the point in time in the discharge process to when the compression process is started is formed in an end face of the swing piston (26). In this configuration, the discharge port (21*b*) is formed in such a manner that an inner end of the discharge port (21*b*) does not directly overlap the annular groove (42) of the eccentric part (33*b*) when the swing piston (26) is in a region between positions forward and backward of the top dead center. The discharge port (21*b*) communicates with the annular groove (42) of the eccentric part (33*b*) through the notch (43) when the swing piston (26) is at the top dead center, and is in the region between the positions forward and backward of the top dead center (in the period from the point in time in the discharge process to when the compression process is started).

In the first alternative, the same advantages as the example shown in FIG. 2 can be provided, and the amount of the oil fed to the discharge port (21*b*) does not vary even when the discharge port (21*b*) is slightly misaligned. The swing piston (26) can integrally be molded by sintering. Thus, a mechanical process for forming the notch (43) is no longer necessary. This can reduce the number of steps of the mechanical process, and can reduce an increase in manufacturing cost.

(Second Alternative)

Figure 5:
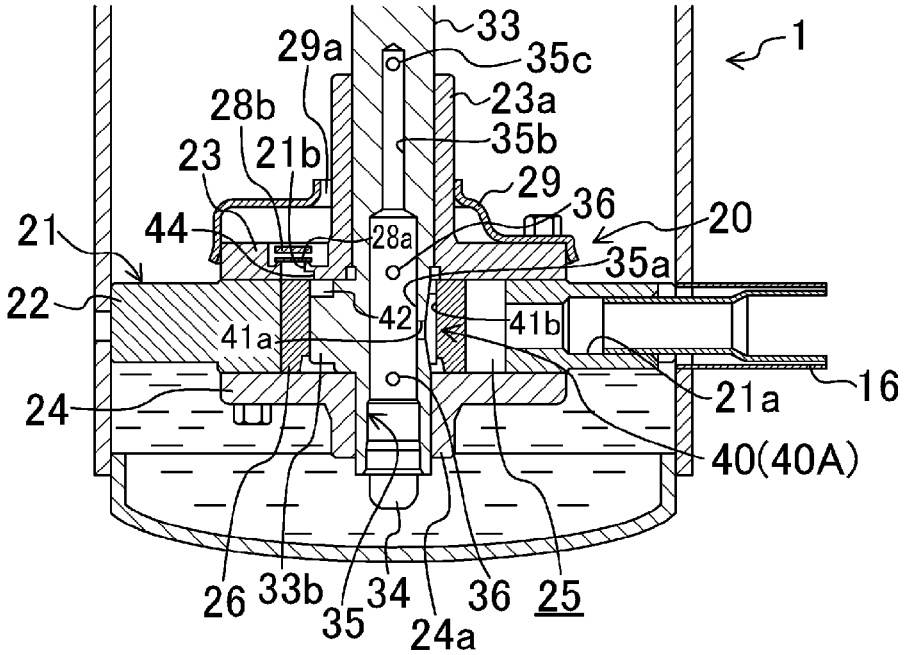
FIGS. 5(A) and 5(B) show a rotary compressor according to a second alternative of the first embodiment.
Figure 5:
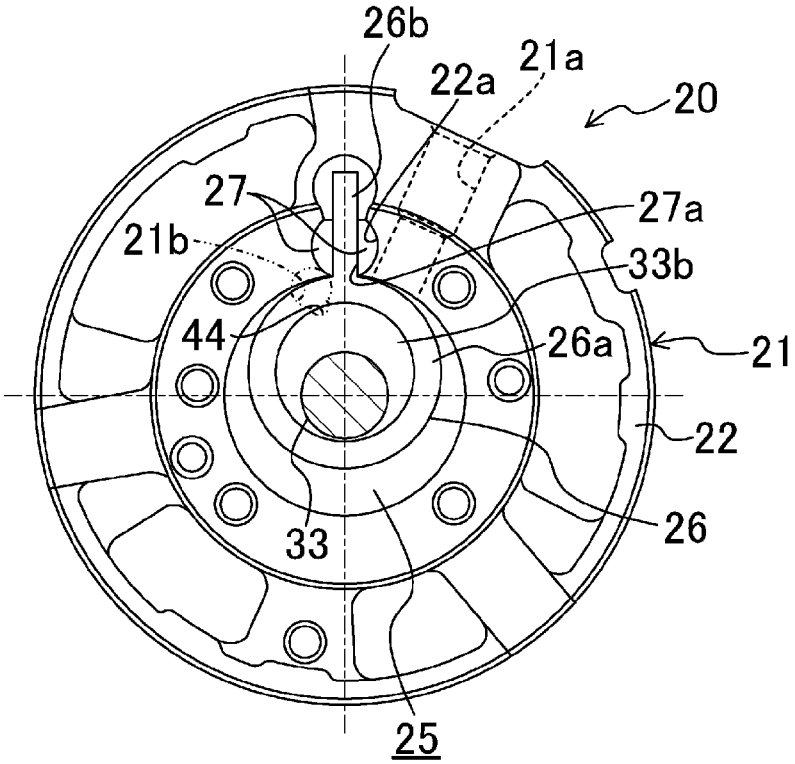

In a second alternative of the first embodiment shown in FIGS. 5(A) and 5(B), the configuration of the oil feed path (40) is different from the examples shown in FIGS. 1-4.

In the oil feed path (40) according to the second alternative, a notch (44) through which the discharge port (21*b*)

communicates with the annular groove (42) of the eccentric part (33*b*) in the period from the point in time in the discharge process to when the compression process is started is formed in the discharge port (21*b*). In this configuration, the discharge port (21*b*) is formed in such a manner that an inner end of the discharge port (21*b*) does not directly overlap the annular groove (42) of the eccentric part (33*b*) when the swing piston (26) is in the region between the positions forward and backward of the top dead center. The discharge port (21*b*) communicates with the annular groove (42) of the eccentric part (33*b*) through the notch (44) when the swing piston (26) is at the top dead center, and is in the region between the positions forward and backward of the top dead center (in the period from the point in time in the discharge process to when the compression process is started).

In this configuration, the same advantages as the example shown in FIG. 2 can be provided, and the amount of the oil fed to the discharge port (21*b*) does not vary even when the discharge port (21*b*) is slightly misaligned. When the front head (23) is formed by sintering, a mechanical process for forming the notch (44) is no longer necessary, thereby reducing an increase in manufacturing cost.

(Third Alternative)

In the above embodiment, the oil is fed to the inside of the discharge port (21*b*) in the period from the point in time in the discharge process to when the compression process is started. However, the oil may be fed to the inside of the discharge port (21*b*) in a shorter period, i.e., in a period from the point in time in the discharge process to when the discharge process is finished. In this case, the oil is present in the discharge port (21*b*) when the discharge process is finished. This can reduce the occurrence of the pulsation caused by the re-expansion of the refrigerant gas when the next compression process is started.

(Fourth Alternative)

In the above embodiment, the oil is fed to the inside of the discharge port (21*b*) in the period from the point in time in the discharge process to when the compression process is started. However, the oil may be fed to the inside of the discharge port (21*b*) in a shorter period, i.e., in a period from when the discharge process is finished to when the compression process is started. In this case, the oil is present in the discharge port (21*b*) before the compression process is started. This can reduce the occurrence of the pulsation caused by the re-expansion of the refrigerant gas when the next compression process is started.

Second Embodiment of the Invention

A second embodiment of the present invention will be described below.

In the second embodiment, the configuration of the oil feed path (40) shown in FIGS. 6(A) and 6(B) is different from the examples shown in FIGS. 1-5.

In the compressors (1) according to the first embodiment and the alternatives shown in FIGS. 1-5, the oil feed path (40) is configured to directly feed the refrigeration machine oil from the oil sump (14) in the casing (10) to the discharge port (21*b*). In this embodiment, the oil feed path (40) is configured in such a manner that the refrigeration machine oil is temporarily contained in the cylinder chamber (25), and then fed to the discharge port (21*b*). Specifically, in the second embodiment, the oil feed path (40) is configured as an indirect oil feed path (40B) which indirectly feeds the refrigeration machine oil in the oil sump (14) to the discharge port (21*b*) through the cylinder chamber (25).

The oil feed path (40) according to the second embodiment includes a communicating groove (45) formed to open in the cylinder chamber (25). The communicating groove (45) is formed in an inner surface of the rear head (24) facing the cylinder chamber (25). The communicating groove (45) is formed with a radially-extending groove extending in a radial direction of the cylinder chamber (25). A length of the communicating groove (45) is slightly greater than a thickness of the oscillating piston body (26*a*) in such a manner that a passage is formed from sliding surfaces of the eccentric part (33*b*) of the drive shaft (33) and the swing piston (26) to the cylinder chamber (25) when a rotation angle of the swing piston (26) is in a range corresponding to a period from when the compression process is started to when the discharge process is finished (in a predetermined range of the rotation angle corresponding to the period between the compression process and the discharge process).

When the compression mechanism (20) of the second embodiment is operated, a refrigerant is sucked into the cylinder chamber (25) through the suction port (21*a*), and is compressed as the swing piston (26) revolves along the inner peripheral surface of the cylinder chamber (25). The refrigerant compressed to become a high pressure refrigerant is discharged to the space inside the casing (10) through the discharge port (21*b*). Then, the suction process, the compression process, and the discharge process described above are repeated.

While the compression mechanism (20) is operated, the refrigeration machine oil is introduced from the oil sump (14) in the casing (10) to the sliding surfaces of the eccentric part (33*b*) and the swing piston (26). The refrigeration machine oil flows from the sliding surfaces to the cylinder chamber (25) through the communicating groove (45) in the range of the rotation angle corresponding to the period from when the compression process is started to when the discharge process is finished. As a volume of a discharge side of the cylinder chamber (25) is reduced, the refrigeration machine oil flows into the discharge port (21*b*) in a period from the point in time in the discharge process to when the compression process is started (in the range of the rotation angle where the oil is fed to the inside of the discharge port (21*b*)). Then, the refrigeration machine oil in the discharge port (21*b*) flows into the cylinder chamber (25) when the next compression process is started. Thus, the re-expansion of the high pressure refrigerant hardly occurs, and the pulsation caused by the re-expansion is reduced. This can reduce vibration and noise of the compressor.

As compared with the first embodiment shown in FIG. 2, design freedom in determining the range of the rotation angle where the oil is fed can be increased. Thus, the oil can easily be fed at an optimum point in time.

Further, unlike the structure of Patent Document 1, the oil feed passage is not always open in the cylinder chamber (25). This can prevent excessive feeding of the oil to the cylinder chamber (25) to prevent the re-expansion.

Alternative of Second Embodiment

Figure 6:
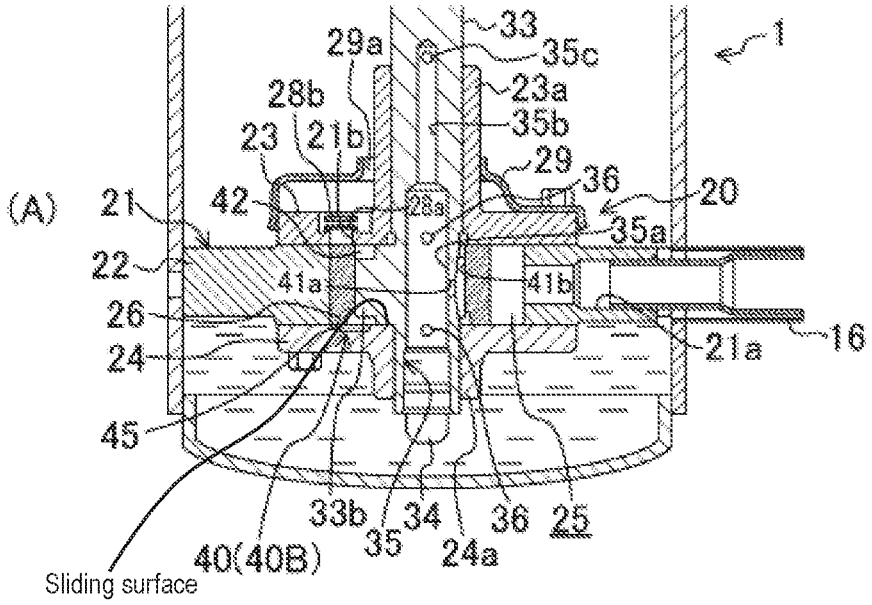
FIGS. 6(A) and 6(B) show a rotary compressor according to a second embodiment.
Figure 6:
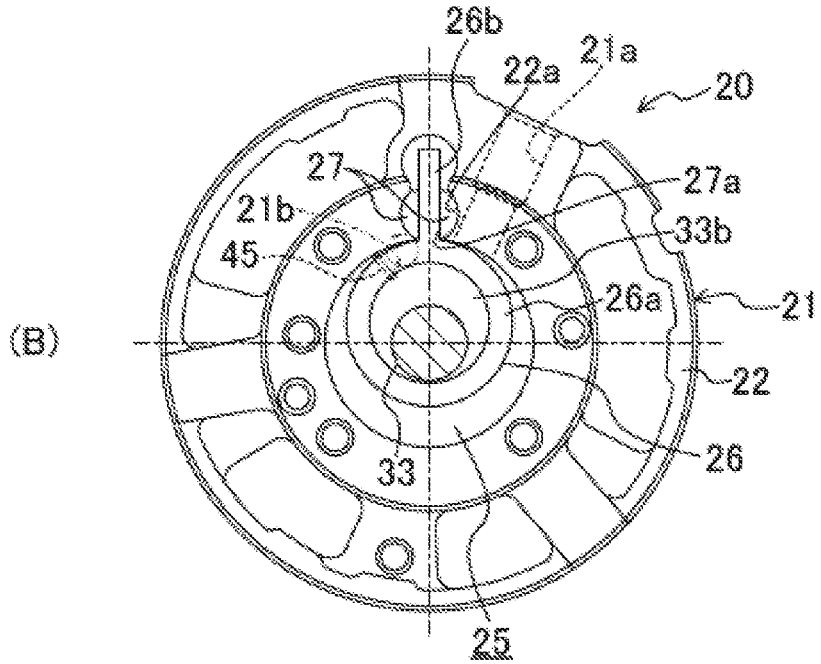

In an alternative of the second embodiment, the configuration of the oil feed path (40) is different from the example shown in FIG. 6.

As shown in FIGS. 7(A), 7(B), and 7(C), the oil feed path (40) of the compression mechanism (20) includes an oil containing recess (46) formed to open in the cylinder chamber (25). The oil containing recess (46) is formed in a surface of the rear head (24) facing the cylinder chamber (25). Thus, the oil containing recess (46) is formed in the cylinder (21) of the compression mechanism (20) to be located away the discharge port (21*b*). The oil containing recess (46) is formed with a round recess.

When the compression mechanism (20) is operated, the refrigeration machine oil is introduced from the oil sump (14) in the casing (10) to sliding surfaces of the eccentric part (33*b*) and the swing piston (26). The refrigeration machine oil is temporarily contained in the oil containing recess (46). When the swing piston (26) revolves along the inner peripheral surface of the cylinder chamber (25) with the refrigeration machine oil contained in the oil containing recess (46), the refrigeration machine oil in the oil containing recess (46) is pushed out of the oil containing recess (46) to the discharge port (21*b*), and flows into the discharge port (21*b*) as the compression process is switched to the discharge process, and the volume of the cylinder chamber (25) is reduced. Thus, the refrigeration machine oil is present in the discharge port (21*b*) in the period from the point in time in the discharge process to when the compression process is started. When the next compression process is started, the re-expansion of the high pressure refrigerant hardly occurs, and the pulsation due to the re-expansion is reduced. This can reduce vibration and noise of the compressor.

As compared with the first embodiment shown in FIG. 2, design freedom in determining the range of the rotation angle at which the oil is fed can be increased. Thus, the oil can easily be fed at an optimum point in time.

Further, unlike the structure of Patent Document 1, the oil feed passage is not always open in the cylinder chamber (25). This can prevent excessive feeding of the oil to the cylinder chamber (25) to prevent the re-expansion.

In this alternative, the amount of the oil fed per rotation can be kept constant. Thus, even when the number of rotations is changed, the dead volume of the discharge port (21*b*) can be reduced by feeding an appropriate amount of the oil.

Referring to FIGS. 8(A)-8(H), a preferable position of the oil containing recess (46) will be described below.

FIGS. 8(A)-8(H) are cross-sectional views of the compression mechanism (20) illustrating that the piston revolves in the order of (A), (B), (C), (D), (E), (F), (G), (H), and (A), i.e., illustrating the swing piston (26) sequentially rotated by an angle of 45°. The swing piston (26) at the top dead center as shown in FIG. 8(A) is regarded as a reference for convenience sake, and a rotation angle thereof is regarded as 0° (360°).

The oil containing recess (46) is formed in an axial end face of the cylinder chamber (25) to be opened/closed by the swing piston (26). Specifically, the oil containing recess (46) is positioned in such a manner that the oil containing recess (46) is exposed from the end face of the swing piston (26) when the suction port (21*a*) is completely closed as shown in FIG. 8(B), is covered with the end face of the swing piston (26) immediately before the discharge process is started as shown in FIG. 8(E), and communicates with the sliding surfaces of the crank shaft (33) and the swing piston (26) in the discharge process as shown in FIG. 8(G).

With the position of the oil containing recess (46) determined in this way, the oil containing recess (46) is covered with the end face of the piston (26) immediately before the discharge process is started as shown in FIG. 8(E), and the oil containing recess (46) communicates with the sliding surfaces of the crank shaft (33) and the piston (26) in the discharge process as shown in FIG. 8(G). The oil is contained in the oil containing recess (46), and is discharged to the cylinder chamber (25) when the suction port (21*a*) is completely closed. The oil is kept contained in the discharge port (21*b*) in the compression process and the next discharge process until the next compression process is started. Thus, when the next compression process of the compression mechanism (20) is started, the oil present in the discharge port (21*b*) at this time is introduced to the low pressure cylinder chamber (25).

Thus, the oil which is discharged to the cylinder chamber (25) when the suction port (21*a*) is completely closed is kept contained in the discharge port (21*b*) until the next compression process is started. Then, when the compression process is started, the oil present in the discharge port (21*b*) when the discharge process is finished is introduced to the low pressure cylinder chamber (25). This can reduce the pulsation due to the re-expansion of the high pressure gas.

Specifically, the oil containing recess (46) is positioned to meet the following conditions:

Diameter of the recess<(Outer diameter of the piston−Inner diameter of the piston)/2

Position in a radial direction=(Outer diameter of the piston+Inner diameter of the piston)/4

Range of rotation angle=190°-310°

Third Embodiment of the Invention

A third embodiment of the present invention will be described below.

Figure 9:
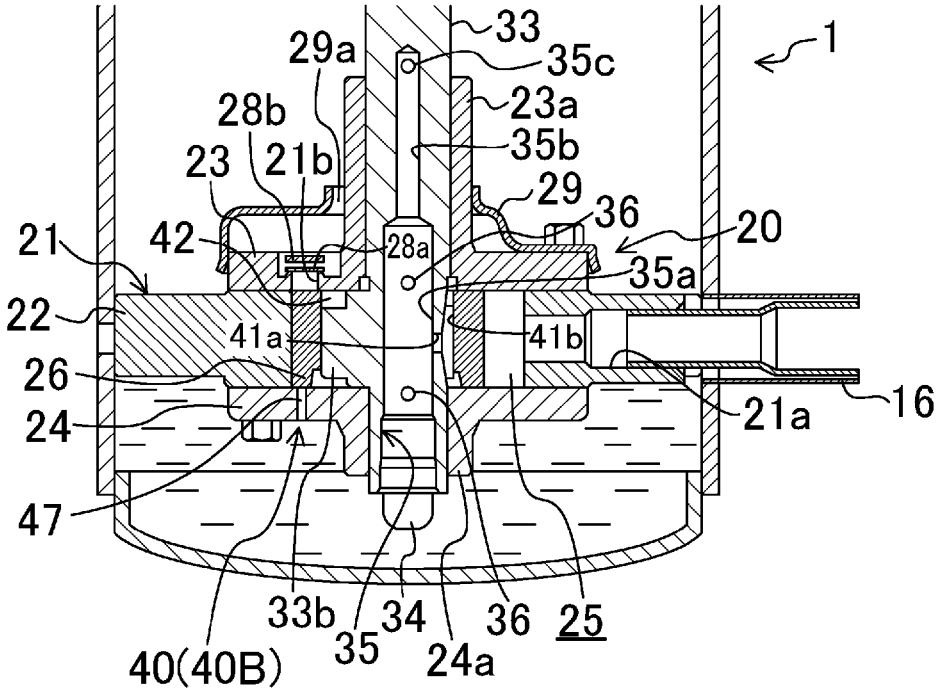
FIGS. 9(A) and 9(B) show a rotary compressor according to a third embodiment.
Figure 9:
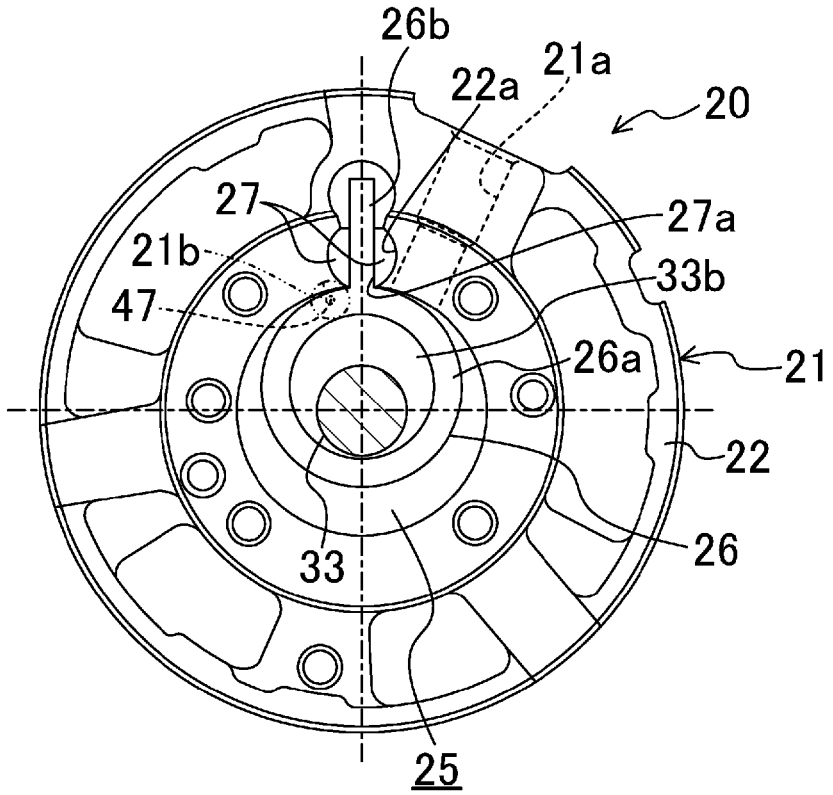

In the third embodiment, the configuration of the oil feed path (40) shown in FIGS. 9(A) and 9(B) is different from the examples shown in FIGS. 1-8.

In the third embodiment, an oil introducing hole (47) through which the oil sump (14) in the casing (10) communicates with the cylinder chamber (25) of the compression mechanism (20) is formed in the cylinder (21).

In this configuration, when the compression mechanism (20) is operated, the oil contained in the oil sump (14) flows into the cylinder chamber (25) through the oil introducing hole (47), and is introduced to the discharge port (21*b*) in the period from the point in time in the discharge process to when the compression process is started. The oil is introduced from the oil introducing hole (47) to the cylinder chamber (25) when the oil introducing hole (47) is intermittently opened while the swing piston (26) is operated. Since the oil is present in the discharge port (21*b*) when the compression process is started, the dead volume of the discharge port (21*b*) is reduced as compared with the case where the oil is not introduced to the discharge port (21*b*). Thus, like the above embodiments, the occurrence of vibration and noise due to the re-expansion of the high pressure refrigerant can be reduced.

As compared with the first embodiment, design freedom in determining the range of the rotation angle at which the oil is fed can be increased. Thus, the oil can easily be fed at an optimum point in time.

Further, the oil introducing hole (47) which intermittently communicates with the cylinder chamber (25) can prevent excessive feeding of the oil to the discharge port (21*b*).

Fourth Embodiment of the Invention

A fourth embodiment of the present invention will be described.

Figure 10:
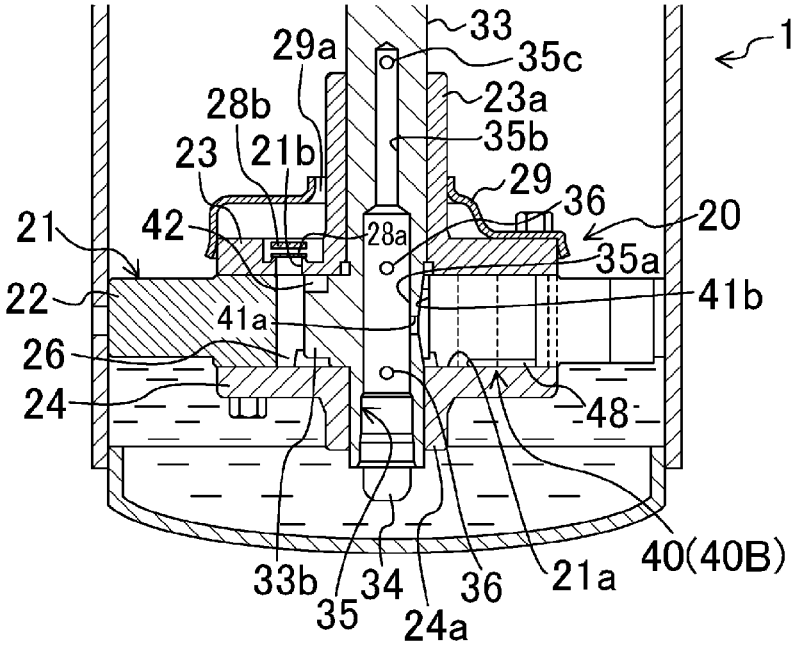
FIGS. 10(A) and 10(B) show a rotary compressor according to a fourth embodiment.
Figure 10:
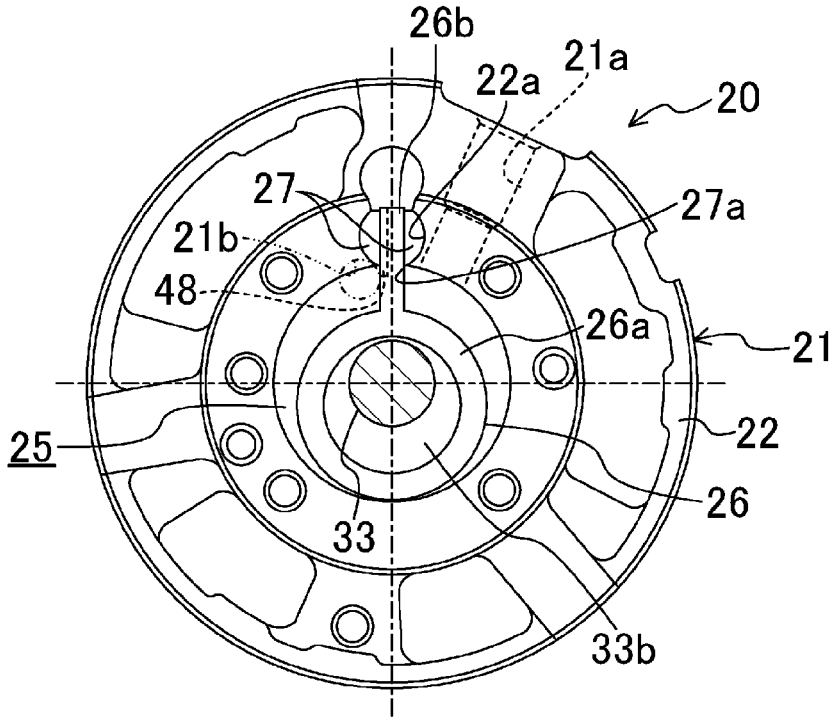

In the fourth embodiment, the configuration of the oil feed path (40) shown in FIGS. 10(A) and 10(B) is different from the examples shown in FIGS. 1-9.

In the fourth embodiment, the compression mechanism (20) is formed with a swing compressor (1) including a piston and a blade (26*b*) integrated with each other. A slit (48) through which a back pressure chamber on a back surface of the blade (26*b*) communicates with the cylinder chamber (25) is formed in a side surface of the blade (26*b*) closer to the discharge port (21*b*).

The slit (48) is formed in a lower end face of the blade (26*b*). In this embodiment, oil level (15) of the oil in the oil sump (14) is determined in such a manner that the slit (48) is kept immersed in the oil. The slit (48) communicates with the cylinder chamber (25) when the swing piston (26) approaches a bottom dead center as shown in FIG. 10(B). Specifically, the slit (48) intermittently communicates with the cylinder chamber (25) while the swing piston (26) is operated.

In the fourth embodiment, while the compression mechanism (20) is operated, the oil in the oil sump (14) passes through the slit (48) to enter the cylinder chamber (25), and is introduced to the discharge port (21*b*) in the period from the point in time in the discharge process to when the compression process is started. Since the oil is present in the discharge port (21*b*) when the compression process is started, the dead volume of the discharge port (21*b*) can be reduced as compared with the case where the oil is not introduced to the discharge port (21*b*). Thus, like the above embodiments, the occurrence of vibration and noise due to the re-expansion can be reduced.

In this embodiment, the oil near the discharge port (21*b*) flows into the cylinder chamber (25). Thus, the oil can reliably be introduced to the discharge port (21*b*).

Further, the slit (48) which intermittently communicates with the cylinder chamber (25) can prevent excessive feeding of the oil to the discharge port (21*b*).

In this embodiment, the slit (48) is formed along the lower end of the blade (26*b*). However, the slit (48) may be formed to extend parallel with the end face of the blade (26) to divide the blade (26*b*) into two halves in a direction of a height. In this case, the amount of the oil in the oil sump (14) is determined to bring the oil level higher than that in the above embodiments. As compared with the slit (48) formed in the vertical center of the blade (26*b*), the slit (48) formed along the lower end of the blade (26*b*) can more reliably reduce the occurrence of vibration and noise due to the re-expansion because the oil can be introduced to the discharge port (21*b*) even when the oil level (15) of the oil in the oil sump (14) is lowered.

Fifth Embodiment of the Invention

A fifth embodiment of the present invention will be described below.

Figure 11:
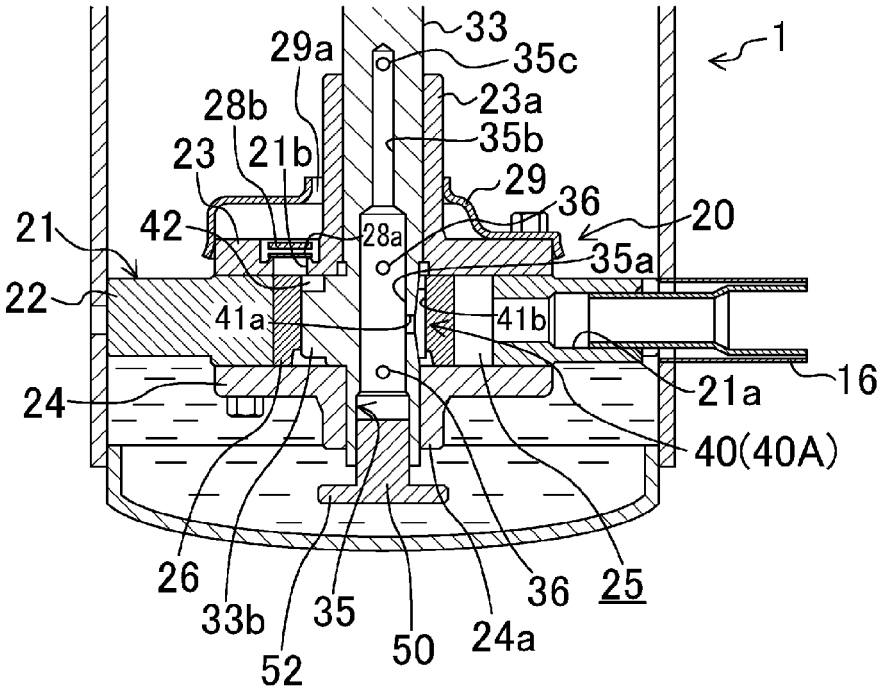
FIGS. 11(A) and 11(B) show a rotary compressor according to a fifth embodiment.
Figure 11:
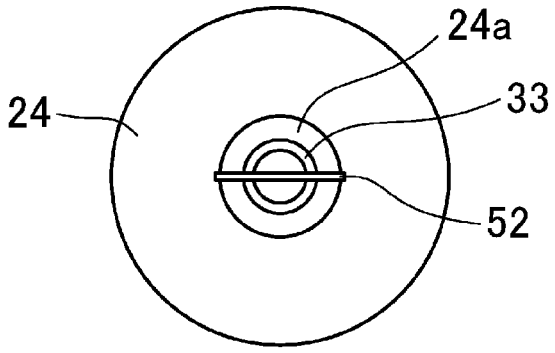

According to the fifth embodiment, as shown in FIGS. 11(A) and 11(B), an oil stirring mechanism (50) for stirring the oil contained in the oil sump (14) in accordance with the rotation of the compression mechanism (20) is provided at a lower end of the crank shaft (33).

As the oil stirring mechanism, an oil stirrer (50) having a stirring impeller (52) at a lower end thereof is attached to a lower end of the crank shaft (33). The stirrer (50) is formed by processing a metal plate of about 1.6 mm in thickness. The stirrer (50) attached to the crank shaft (33) is rotated in accordance with the rotation of the compression mechanism (20).

The stirrer (50) of the present embodiment may be applied to any one of the first to fourth embodiments and their alternatives.

In this embodiment, the oil contained in the oil sump (14) is stirred with the stirring impeller (52), and the refrigerant dissolved in the refrigeration machine oil is foamed, and is separated from the oil. Thus, the oil in which almost no refrigerant is dissolved is fed to the discharge port (21*b*) of the compression mechanism (20). This can reduce the refrigerant flowing from the discharge port (21*b*) to the cylinder chamber (25) when the compression process is started, thereby effectively reducing the occurrence of the pulsation.

A centrifugal force is acted on the refrigeration machine oil flowing upward through the oil feed passage (35*a*). Thus, the refrigeration machine oil is fed to the compression mechanism (20) through the radially-opened oil feed hole (41*a*) and the axially-extending slit (41*b*) by the centrifugal force. The refrigerant separated from the oil also flows upward through the oil feed passage (35*a*). However, the gaseous refrigerant does not receive the centrifugal force because it is light, and is concentrated to the center of the passage. The bubbles of the refrigerant flowing upward through the center of the oil feed passage (35*a*) flows upward through the degassing passage (35*b*), and then flows into the casing (10) through the degassing hole (35*c*).

Other Embodiments

The above-described embodiments may be modified in the following manner.

For example, the first to third embodiments describe examples where the present invention is applied to the compressor (1) including the swing piston type compression mechanism (20). However, the oil feed path (40) of the first embodiment may be applied to a compressor (1) including a rolling piston type compression mechanism (20) in which a cylindrical piston and a flat blade (26*b*) are separate members, and a radially inner end of the blade (26*b*) is press-fitted to an outer peripheral surface of the piston.

Figure 7:
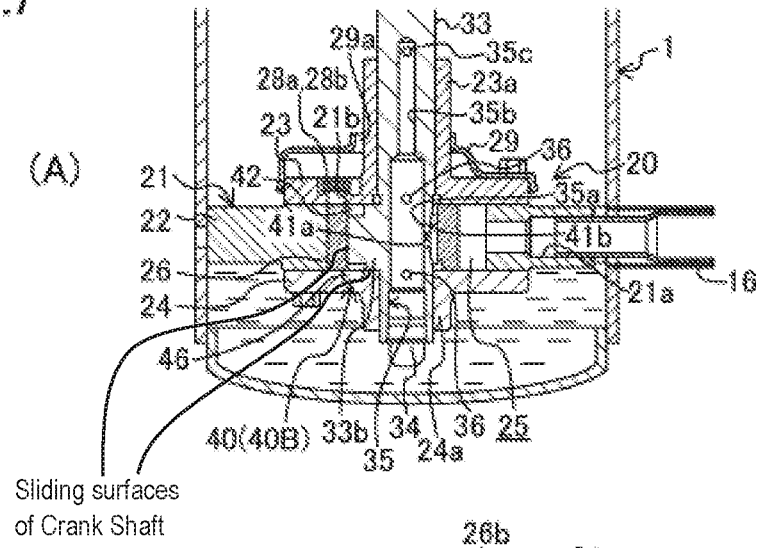
FIGS. 7(A) to 7(C) show a rotary compressor according to an alternative of the second embodiment.
Figure 7:
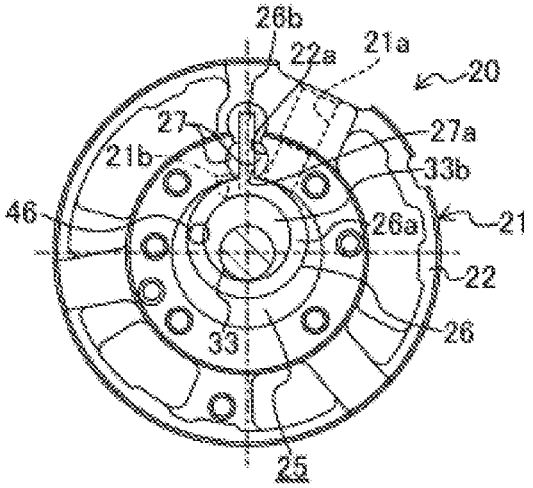
Figure 7:
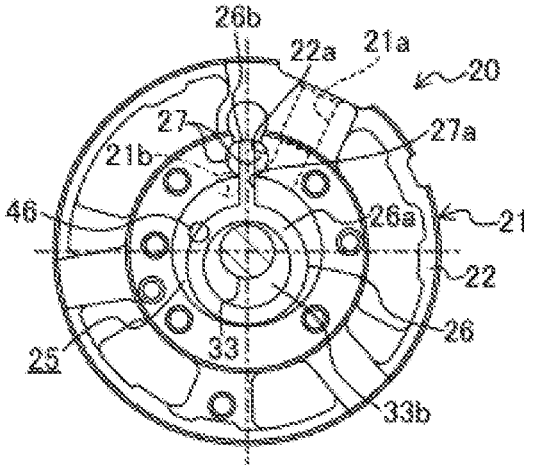
Figure 8:
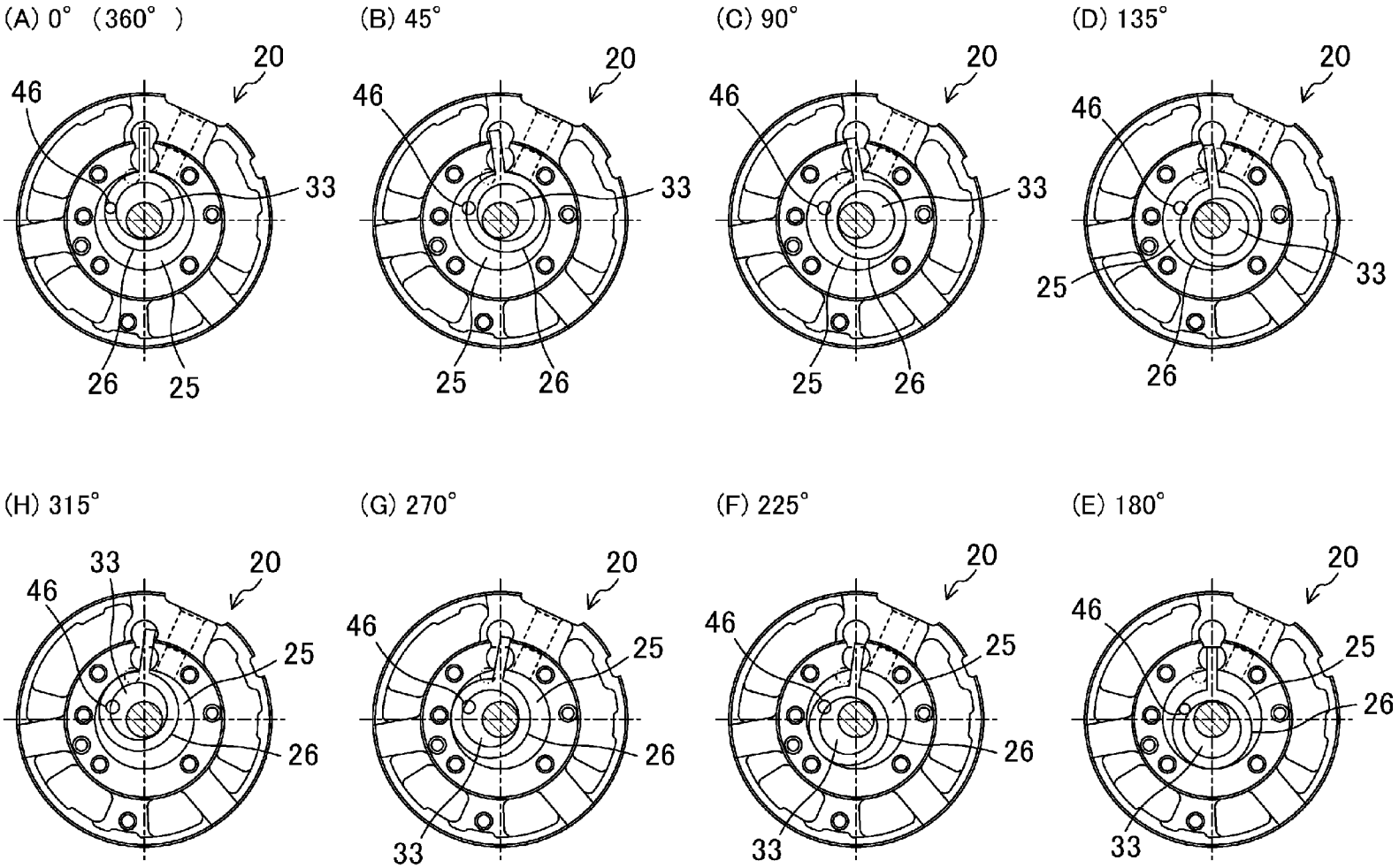
FIGS. 8(A)-8(H) are cross-sectional views illustrating how a piston revolves.

The communicating groove (45) shown in FIG. 6, and the oil containing recess (46) shown in FIG. 7 may be provided in the front head.

In the above-described embodiments, the reed valve is used as the discharge valve (28*a*). However, the discharge valve (28*a*) of the present invention is not limited to the reed valve, and a poppet valve may be used in place of the reed valve.

In the second to fifth embodiments, the refrigeration machine oil is fed to the discharge port (21*b*) in the period from the point in time in the discharge process to when the compression process is started, and the oil flows from the discharge port (21*b*) to the cylinder chamber (25) when the next compression process is started. However, the oil may be fed to the discharge port (21*b*) in a period from the point in time in the discharge process to when the discharge process is finished, or in a period from when the discharge process is finished to when the compression process is started. In either case, the oil is fed before the compression process is started. Thus, the occurrence of the pulsation due to the re-expansion of the gaseous refrigerant can be reduced.

The above-described embodiments have been set forth merely for the purposes of preferred examples in nature, and are not intended to limit the scope, applications, and use of the invention.

INDUSTRIAL APPLICABILITY

As described above, the present invention is useful for technologies of reducing the vibration and noise which are caused when the high pressure gas which remains in the discharge port (21*b*) of the compression mechanism (20) of the rotary compressor (1) returns to the cylinder chamber (25) and re-expands therein.

What is claimed is:

1. A high pressure dome rotary compressor comprising:

a casing;

a crank shaft extending in a vertical direction, the crank shaft having an eccentric part, and the casing having a bottom at a lower end of the crank shaft; and a rotary compression mechanism disposed in the casing, the rotary compression mechanism having a piston attached to the crank shaft and arranged to revolve in a cylinder along an inner peripheral surface of the cylinder when the crank shaft having the eccentric part is rotated to compress and discharge gas in a cylinder chamber defined by the piston and cylinder in a least one compression process and at least one discharge process that occur during a plurality of operation cycles during operation of the rotary compressor, the rotary compression mechanism further defining a discharge port and including a discharge valve, and a single cycle of the operation of the plurality of operation cycles of the rotary compressor occurs with a first 360° rotation of the crank shaft such that a compression process of the at least one compression process and a discharge process of the at least one discharge process occur within the first 360° rotation of the crank shaft, the discharge valve being opened in the first 360° rotation of the crank shaft in the discharge process and closed in the first 360° rotation of the crank shaft during a period of time from when the discharge process is finished to when a next compression process is started in a subsequent second 360° rotation of the crank shaft, the rotary compressor being arranged and configured such that high pressure gas discharged from the discharge port in the at least one discharge process is discharged outside the casing through an opening in the casing, and an oil feed path formed within the casing, the crank shaft and the discharge port being shaped and located to, in combination, define the oil feed path configured to route lubricant oil contained in an oil sump at the bottom of the casing to an inside of the discharge port, the discharge valve having an inlet side and an outlet side, with refrigerant flowing from the compression chamber on the inlet side to the outlet side when the discharge valve is open, the discharge port being on the inlet side, and the oil feed path being disposed on the inlet side of the discharge valve, wherein the oil feed path is at least one of open to the inside of the discharge port when the discharge valve is open so that the discharge port receives the lubricant oil routed in the oil feed path as the crank shaft rotates through a first rotational angle range of the first 360° rotation of the crank shaft, the first rotational angle range being in a period of time from the point in time in the discharge process to when the discharge process is finished, and open to the inside of the discharge port when the discharge valve is closed so that the discharge port receives the lubricant oil routed in the oil feed path as the crank shaft rotates through a second rotational angle range from an end of the first rotational angle range in the first 360° rotation of the crank shaft to a point in the second 360° rotation of the crank shaft, the second rotational angle range being in a period of time from when the discharge process is finished to when the compression process is started, and wherein the oil feed path is closed to the inside of the discharge port when the discharge valve is closed so that the discharge port does not receive the lubricant oil routed in the oil feed path as the crank shaft rotates through a third rotational angle range of the second 360° rotation of the crank shaft, the third rotational angle range being in a period of time from when the compression process is started.

2. The rotary compressor of claim 1, wherein the oil feed path is open to the inside of the discharge port when the discharge valve is open so that the discharge port receives the lubricant oil routed in the oil feed path as the crank shaft rotates through the first rotational angle range of the first 360° rotation of the crank shaft, the first rotational angle range being in a period of time from the point in time in the discharge process to when the discharge process is finished.

3. The rotary compressor of claim 1, wherein the oil feed path is open to the inside of the discharge port when the discharge valve is closed so that the discharge port receives the lubricant oil routed in the oil feed path as the crank shaft rotates through the second rotational angle range from an end of the first rotational angle range in the first 360° rotation of the crank shaft to a point in the second 360° rotation of the crank shaft, the second rotational angle range being in a period of time from when the discharge process is finished to when the compression process is started.

4. The rotary compressor of claim 1, wherein a top dead center position of the piston forms a rotation angle reference point of 0°, a position at which the at least one discharge process of the rotary compression mechanism is finished is at a rotation angle approaching about 330° relative to the rotation angle reference point, the at least one discharge process being when the discharge valve is open, and when the first rotational angle range finishes is when the at least one discharge process finishes, a position at which the compression process of the rotary compression mechanism is started is at a rotation angle of about 45° relative to the rotation angle reference point, and the oil feed path is open to the inside of the discharge port when the rotation angle is between 315° and 45° relative to the rotation angle reference point.

5. The rotary compressor of claim 1, further comprising:

an oil stirring mechanism arranged to stir the lubricant oil contained in the oil sump in accordance with rotation of the rotary compression mechanism, the oil stirring mechanism including a stirring impeller attached to the lower end of the crank shaft to rotate therewith.

6. The rotary compressor of claim 1, wherein the rotary compression mechanism includes a communicating groove defined by a part of the rotary compression mechanism, the communicating groove has an end opened to a sliding surface of the rotary compression mechanism and an other end opened to the cylinder chamber as the crank shaft rotates through the first rotational angle range.

7. The rotary compressor of claim 1, wherein the rotary compression mechanism includes an oil containing recess defined by an inner wall surface of the cylinder chamber to contain the lubricant oil fed from the oil sump to the cylinder chamber.

8. The rotary compressor of claim 7, wherein the oil containing recess is formed in an end face of the cylinder chamber, the oil containing recess being opened/closed by the piston such that the oil containing recess is exposed from an end face of the piston in the period from when the at least one discharge process is finished to when the compression process is started, and when the first rotational angle range finishes is when the at least one discharge process finishes, is covered with the end face of the piston before the at least one discharge process is started, and communicates with sliding surfaces of the crank shaft and the piston in the at least one discharge process when the discharge valve is open.

9. The rotary compressor of claim 1, wherein the oil feed path is an oil introducing hole formed vertically through a rear head defining a rear vertical end of the cylinder, and the oil sump in the casing communicates with the cylinder chamber of the rotary compression mechanism through the oil introducing hole.

10. The rotary compressor of claim 1, wherein the rotary compression mechanism includes a blade extending from the piston to form a swing piston, and a suction port of the rotary compression mechanism and the discharge port are arranged to sandwich the blade therebetween, and a slit is defined by a side surface of the blade on a discharge port side, a back pressure chamber is defined on a back surface of the blade, and the back pressure chamber communicates with the cylinder chamber through the slit.

11. A high pressure dome rotary compressor comprising:

a casing;

a crank shaft extending in a vertical direction, the crank shaft having an eccentric part, and the casing having a bottom at a lower end of the crank shaft; and a rotary compression mechanism disposed in the casing, the rotary compression mechanism having a piston attached to the crank shaft and arranged to revolve in a cylinder along an inner peripheral surface of the cylinder when the crank shaft having the eccentric part is rotated to compress and discharge gas in a cylinder chamber defined by the piston and cylinder in a least one compression process and at least one discharge process that occur during a plurality of operation cycles during operation of the rotary compressor, the rotary compression mechanism further defining a discharge port and including a discharge valve, and a single cycle of the operation of the plurality of operation cycles of the rotary compressor occurs with a first 360° rotation of the crank shaft such that a compression process of the at least one compression process and a discharge process of the at least one discharge process occur within the first 360° rotation of the crank shaft, the discharge valve being opened in the first 360° rotation of the crank shaft in the discharge process and closed in the first 360° rotation of the crank shaft during a period of time from when the discharge process is finished to when a next compression process is started in a subsequent second 360° rotation of the crank shaft, the rotary compressor being arranged and configured such that high pressure gas discharged from the discharge port in the at least one discharge process is discharged outside the casing through an opening in the casing, and an oil feed path formed within the casing, the crank shaft and the discharge port being shaped and located to, in combination, define the oil feed path configured to route lubricant oil contained in an oil sump at the bottom of the casing to an inside of the discharge port, wherein the oil feed path is at least one of open to the inside of the discharge port when the discharge valve is open so that the discharge port receives the lubricant oil routed in the oil feed path as the crank shaft rotates through a first rotational angle range of the first 360° rotation of the crank shaft, the first rotational angle range being in a period of time from the point in time in the discharge process to when the discharge process is finished, and open to the inside of the discharge port when the discharge valve is closed so that the discharge port receives the lubricant oil routed in the oil feed path as the crank shaft rotates through a second rotational angle range from an end of the first rotational angle range in the first 360° rotation of the crank shaft to a point in the second 360° rotation of the crank shaft, the second rotational angle range being in a period of time from when the discharge process is finished to when the compression process is started, wherein the oil feed path is closed to the inside of the discharge port when the discharge valve is closed so that the discharge port does not receive the lubricant oil routed in the oil feed path as the crank shaft rotates through a third rotational angle range of the second 360° rotation of the crank shaft, the third rotational angle range being in a period of time from when the compression process is started, and wherein the eccentric part defines a recess formed therein, the recess being part of the oil feed path, and the recess is configured to communicate with the discharge port of the rotary compression mechanism as the crank shaft rotates through the first rotational angle range.

12. The rotary compressor of claim 11, wherein the discharge port is a through hole which is defined by a part of the rotary compression mechanism, and the through hole partially overlaps the recess as the crank shaft rotates through the first rotational angle range.

13. The rotary compressor of claim 11, wherein the discharge port is a through hole defined by a part of the rotary compression mechanism, and the through hole is located radially outward from an orbit in which the recess revolves, and a notch is defined by an end face of the piston, the notch being part of the oil feed path, and the recess communicates with the inside of the discharge port through the notch as the crank shaft rotates through the first rotational angle range.

14. The rotary compressor of claim 11, wherein the discharge port is a through hole defined by a part of the rotary compression mechanism, and the through hole is located radially outward from an orbit in which the recess revolves, and the part of the rotary compression mechanism further defines a notch extending from the through hole, the notch being part of the oil feed path, and the recess communicates with the inside of the discharge port through the notch as the crank shaft rotates through the first rotational angle range.

* * * * *